United States Patent [19]
Sekiya et al.

[11] Patent Number: 4,645,303
[45] Date of Patent: Feb. 24, 1987

[54] LIQUID CRYSTAL MATRIX DISPLAY PANEL DRIVE METHOD

[75] Inventors: Fukuo Sekiya, Tanashi; Hiroshi Shimizu, Tokorozawa, both of Japan

[73] Assignee: Citizen Watch Co., Ltd., Tokyo, Japan

[21] Appl. No.: 724,423

[22] Filed: Apr. 18, 1985

[30] Foreign Application Priority Data

Apr. 20, 1984 [JP] Japan ..... 59-79777

[51] Int. Cl.[4] ..... G05F 3/147
[52] U.S. Cl. ..... 350/332; 340/805
[58] Field of Search ..... 350/332, 333; 340/792, 340/784, 752, 805, 784, 798; 364/518; 740/811

[56] References Cited

U.S. PATENT DOCUMENTS 4,278,974 7/1981 Kondo ..... 350/333

*Primary Examiner*—Arthur G. Evans
*Attorney, Agent, or Firm*—Jordan and Hamburg

[57] ABSTRACT

An improved drive method is disclosed for a liquid crystal matrix display panel having display elements driven by a set of common conductors which are successively addressed during row selection intervals and a set of segment conductors to which data signals are applied, whereby the number of transitions of polarity of the drive voltage applied to each display element during a non-selection interval for that display element in each frame, as measured over any four successive frame intervals, is made independent of the display pattern formed by the column of display elements containing that display element, with the polarity transitions being distributed substantially uniformly throughout each set of four frame intervals. Contrast variations which arise with prior art drive methods for large-area high element-density displays, due to pattern-dependent effects resulting from matrix conductor resistance and display element capacitance, are thereby completely eliminated.

6 Claims, 30 Drawing Figures

LIQUID CRYSTAL MATRIX DISPLAY PANEL DRIVE METHOD

BACKGROUND OF THE INVENTION

The present invention relates to a method of driving a liquid crystal matrix display panel, and is particularly directed towards a drive method for a liquid crystal matrix display panel having a large number of display elements, suitable for use as a display terminal in data processing equipment. Such a display is utilized for patterns which represent characters, numerals or graphics (e.g. charts, etc) and which are generally held static on the display screen, or move relatively slowly across the screen. Thus, the patterns produced by such a display will in general remain static during a large number of successive frame intervals (with all of the rows of elements of the display being successively scanned during each frame interval). For ease of description, it will be assumed in the following that each display element of a liquid crystal matrix display panel can attain only an ON and an OFF state, and that the conductors connected to respective rows of display elements, which are successively scanned by drive signal pulses of fixed amplitude (generally referred to as common drive signals), are aligned horizontally and will be referred to as common conductors, while the vertically arrayed conductors which are connected to respective columns of display elements and are driven by data-dependent signals (generally referred to as segment drive signals) will be referred to as segment conductors. It will also be assumed that the display is of the type in which a display element is set in the ON state, to appear dark in color against a background of light-colored OFF state display elements, by application of an RMS level of voltage to the display element of sufficiently high value. The invention is however not limited to liquid crystal displays of the latter type. All of the rows of display elements are successively scanned by the common drive signals during each of successive frame intervals.

As the number of display elements of a liquid crystal matrix display panel is increased, it is found that the display quality deteriorates. Specifically, a reduction of contrast occurs, i.e. the most completely "black" level of display cannot be attained. This is due to various factors, the most important of which are the effects of increased resistance of the conductors which supply drive signals to the display elements, as the size of the display matrix is increased, in conjunction with increased display element capacitance which must be charged and discharged by drive signals applied over those conductors, together with reduction of the duty o5 ratio for which each display element is driven. The present invention is directed towards a further problem which has arisen in recent years with the development of liquid crystal matrix display panels having a large area and a very high display element density, e.g. having 100 rows of display elements or more. This problem is manifested as display contrast irregularity, i.e. the coloration of dark-state and light-state areas of the display is not uniform over the entire display, but is pattern-dependent. For example, in a column of display elements containing a number of successively adjacent display elements which are all driven to the ON (i.e. dark) state, the degree of dark-state density attained by the ON state display elements will be higher (and the OFF state display elements will appear darker) than in the case of an ON state display element in a column in which a number of display elements are successively set in the ON and OFF states in an alternating manner. This effect is due to the fact that, although each display element is periodically addressed to be driven into the ON state or OFF state by voltages applied simultaneously to the corresponding X and Y-direction conductors, the effective RMS value of drive voltage applied to a display element will be affected by the states of other display elements driven by the same common conductor. For each display element, during the nonselection portion of each frame interval (i.e. all of the frame interval other than the portion in which that display element is addressed), a drive signal will be applied which will vary in waveform in accordance with the display states of the other display elements in the same column. If this drive signal contains a substantial high-frequency component then this will be effectively blocked by the resistive impedance of the long, narrow and transparent (hence extremely thin) drive conductors, in combination with the capacitances of the display elements, and so does not significantly affect the effective drive voltage applied to each display element of that column. However if the drive signal contains a large low frequency component, then this will be less affected by the latter resistance-capacitance blocking effect, and will result in a higher RMS drive voltage being applied to each display element driven by that segment conductor. As a result very conspicuous effects, such as vertical stripes of varying density in the (light color) background areas will appear on the display, which will move in accordance with changes in the display pattern.

This problem of pattern-dependent display contrast variation is increased as the display element density and the number of display elements is increased, since the increased display element density will necessitate reduction of drive conductor cross-sectional area and hence increased conductor resistance, while resistance will be further increased by the greater lengths of the common conductors and segment conductors as the number of display elements in the display is increased, while the amount of display element capacitance connected to each drive conductor will also increase proportionately.

Methods of overcoming this problem have been proposed hitherto, as described hereinafter, but these have only proven partially successful. One such proposal has been made in a paper entitled "SID Japan Display '83—the 3d International Display Research Conference Post-Deadline Papers PD5". However as described hereinafter, this proposed method is not effective for all display patterns.

SUMMARY OF THE INVENTION

With a drive method according to the present invention, for any adjacent pair of display elements arrayed along the same display column, each of four different modes of drive voltage polarity alternation is applied M times (where M is an integer) during every 4M successive frame intervals, in the pair of successive intervals in each frame during which these two elements are successively addressed. These modes are referred to as polarity alternation sub-sequences in the following, and consist of a sub-sequence in which both of the display elements are driven with a positive polarity during their respective selection intervals within a frame interval, a sub-sequence in which a first one of the elements is driven with a negative and the other with a positive polarity, a sub-sequence in which the first element is drive with a positive and the other with a negative polarity, and a sub-sequence in which both of the display elements are driven with a negative drive voltage polarity.

The value of M is preferably made equal to 2, in which case four different sequences of polarity alternation of the drive voltage applied during a frame interval to each pair of adjacent display elements along each display column occur during any four consecutive frame intervals. As a result, irrespective of which of the 4 possible display patterns of any (column oriented) adjacent pair of display elements is designated by the display data, spurious drive signals applied to every other element in the same column as a result of driving that pair of display elements will produce an effect which is independent of the display pattern formed by that adjacent pair of elements, since the average number of polarity transitions of such spurious drive signals (averaged over four or more successive frame intervals) will be constant. Since every pattern which can be produced by a column of display elements containing K pairs of mutually adjacent elements must consist of K combinations of the four possible display patterns which can be produced by each pair of mutually adjacent elements, this method ensures that the pattern-dependent interference effects described above can be eliminated.

The method of the present invention enables pattern-dependent variations in the "dark" and "light" states of display elements to be eliminated, even in the case of a panel having a large number of elements and a high element density.

Utilizing the method of the present invention, "flickering" variation of display pattern density is eliminated if it is ensured that the duration of each cycle interval is shorter than the response time of the liquid crystal, i.e. the maximum time interval for which a variation in drive voltage level applied to a display element will produce no visually perceptible change in display element coloration.

DESCRIPTION OF THE PREFERRED EMBODIMENTS

Figure 1:
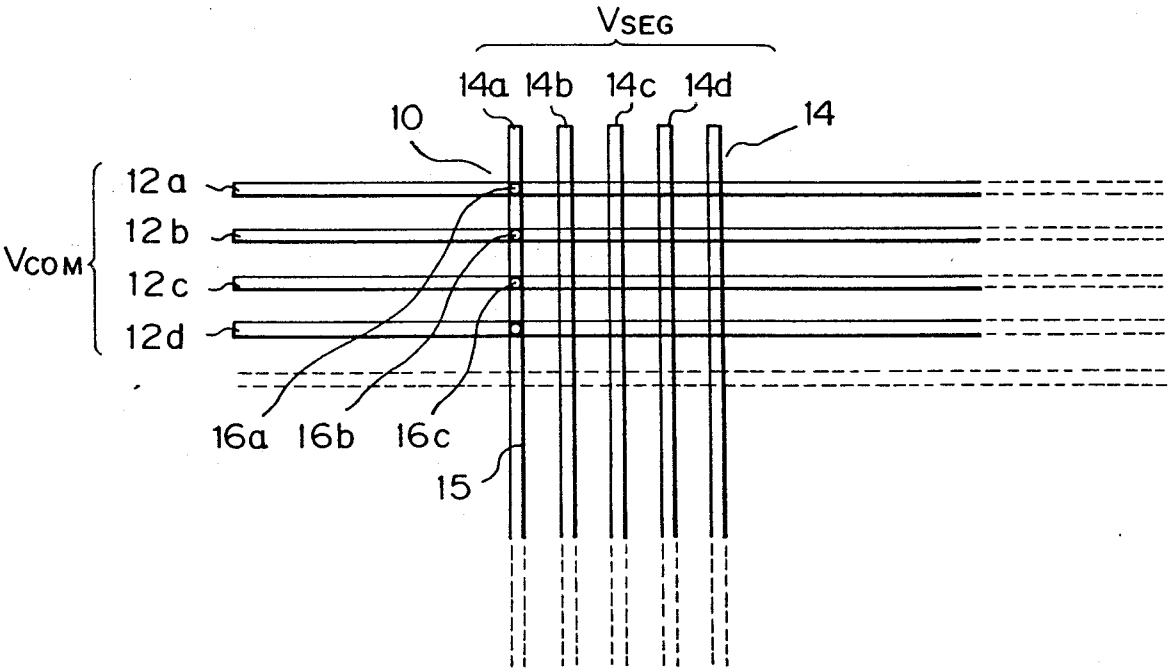
FIG. 1 is a simplified plan view of part of a liquid or mat display panel.
Figure 2A:
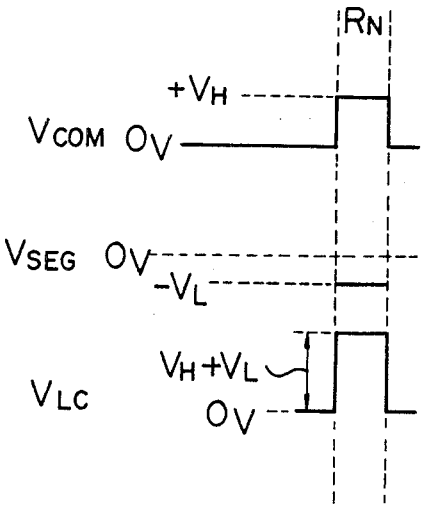
FIGS. 2A and 2B are diagrams to show the relationship between common and segment drive signal levels during a row selection interval and the resultant drive voltage applied to the corresponding addressed d element.
Figure 2B:
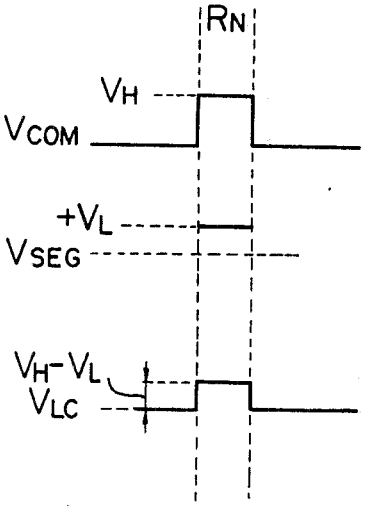

FIG. 1 illustrates the basic elements of a liquid crystal matrix display panel, in very simplified form. A set of horizontally oriented drive conductors 12, referred to in the following as common conductors, are successively scanned by selection voltage signals, generally referred to as common drive signals. The time interval during which a common conductor is addressed by a common drive signal will be referred to as a row selection interval, and the duration of one row selection interval as 1H. The time taken to completely scan all of the common conductors will be referred to as a frame interval, i.e. each display element in a column of the matrix array will be addressed during a 1H interval, once in every frame interval. A set of vertically oriented drive conductors 14, referred to in the following as segment conductors, receive data drive signals, generally referred to as segment drive signals. Liquid crystal is sandwiched between these two sets of drive conductors, with display elements being thereby driven at the intersections of the conductors, e.g. display elements 16a, 16b, 16c, . . . in FIG. 1 are driven into display states which are determined by the level of the segment drive signal $V_{SEG}$ applied to common conductor 15 during the intervals in which the corresponding common conductors are addressed. The manner in which each display element is addressed by the common and segment drive signals is illustrated in FIGS. 2A and 2B. In FIG. 2A, the drive voltage $V_{LC}$ is shown for a display element which is addressed during a row selection interval $R_N$ by the corresponding common drive signal $V_{COM}$. As shown signal $V_{COM}$ rises from the zero (0V) level to the $+V_H$ level during row selection interval $R_N$. If this display element is to be set in the ON state, then the segment drive signal $V_{SEG}$ goes to the level $-V_L$ during row selection interval $R_N$ As a result, a drive voltage $V_{LC}$ of level $(V_H+V_L)$ is developed across this display element during the $R_N$ row selection interval of each successive frame interval. If the display element is to be set in the OFF state, then during each row selection interval $R_N$ of that display element, signal $V_{SEG}$ goes to the $+V_L$ level, so that a potential of only $(V_H-V_L)$ is applied across the display element during row selection interval $R_N$, in successive frame intervals. Ideally, an RMS voltage value of sufficient magnitude to produce maximum "dark state" density should thereby be applied to each display element which is addressed to be set in the ON state, while an RMS voltage producing a perfect "light state" density should be applied to each display element which is addressed to be set in the OFF state.

An identical effect can be obtained if the polarities shown in FIGS. 2A and 2B are inverted, i.e. such that a display element is driven to the ON state by a high negative voltage, e.g. $-(V_H+V_L)$ during the corresponding row selection interval, and is set to the OFF state by a low negative voltage, e.g. $-(V_H-V_L)$. In the following, the condition shown in FIGS. 2A and 2B will be referred to as the positive drive state, while the opposite condition will be referred to as the negative drive state. In a practical display system, a single control signal referred to in the following as a polarity control signal is used to selectively establish these drive states. It will be assumed that when this polarity control signal is at a predetermined high potential, the positive drive state is established, while when the polarity control signal is at a predetermined low potential, the negative drive state is established.

Figure 2C:
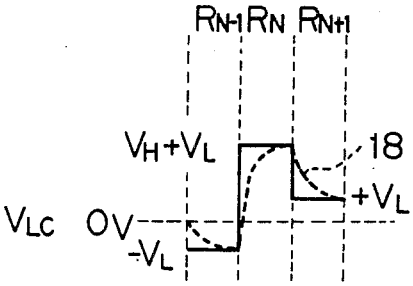
FIGS. 2C and 2D illustrate the drive voltage waveforms applied to a display element addressed during a row selection interval $R_N$, for two different display patterns.
Figure 2D:
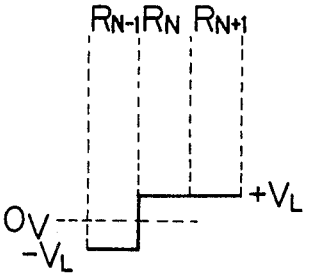

FIG. 2C illustrates the drive voltage applied during three successive row selection intervals to a display element which is addressed during row selection interval $R_N$, for the case in which this display element is set to the ON state while the adjacent display element (of the same column) addressed during the preceding row selection interval $R_{N-1}$, is set to the OFF state and the adjacent display element (of the same column) addressed during the succeeding row selection interval, $R_{N+1}$, is set to the ON state. This is the drive voltage which would be applied to display element 16b in FIG. 1, for example, during the first, second and third row selection intervals of each frame interval, if that display element is set in the ON state and display elements 16a and 16c are set in the OFF and ON states respectively. FIG. 2D shows the corresponding drive voltage waveform for this display element for the case in which it is set to the OFF state, while the preceding and succeeding display elements remain in the OFF and ON states respectively.

For each display element, the portion of each frame interval during which the display element is not addressed will be referred to as the non-selection interval. Thus, row selection intervals $R_{N-1}$ and $R_{N+1}$ fall within the non-selection interval of a display element which is addressed during row selection interval $R_N$. It can thus be understood that for the positive drive state, the drive voltage applied to a display element during any specific row selection interval within the non-selection interval of that display element will be positive (e.g. $+V_L$) if the display element which is in the same column of the element array as the first-mentioned display element and is addressed during that row selection interval is driven to the ON state, and will be negative (e.g. $-V_L$) if the latter display element is driven to the OFF state. When the negative drive state is established, the opposite will be true. That is, the drive voltage applied to a display element during any specific row selection interval within the non-selection interval of that display element will be negative (e.g. $-V_L$) if the display element which is in the same column of the element array as the first-mentioned display element and is addressed during that row selection interval is driven to the ON state, and will be positive (e.g. $+V_L$) if the latter display element is driven to the OFF state.

Due to the resistance-capacitance impedance effect described hereinabove, the actual drive voltage waveform applied to a display element will not be of square shape, but will be distorted as indicated by dotted-line portion 18 in FIG. 2C.

Figure 3:
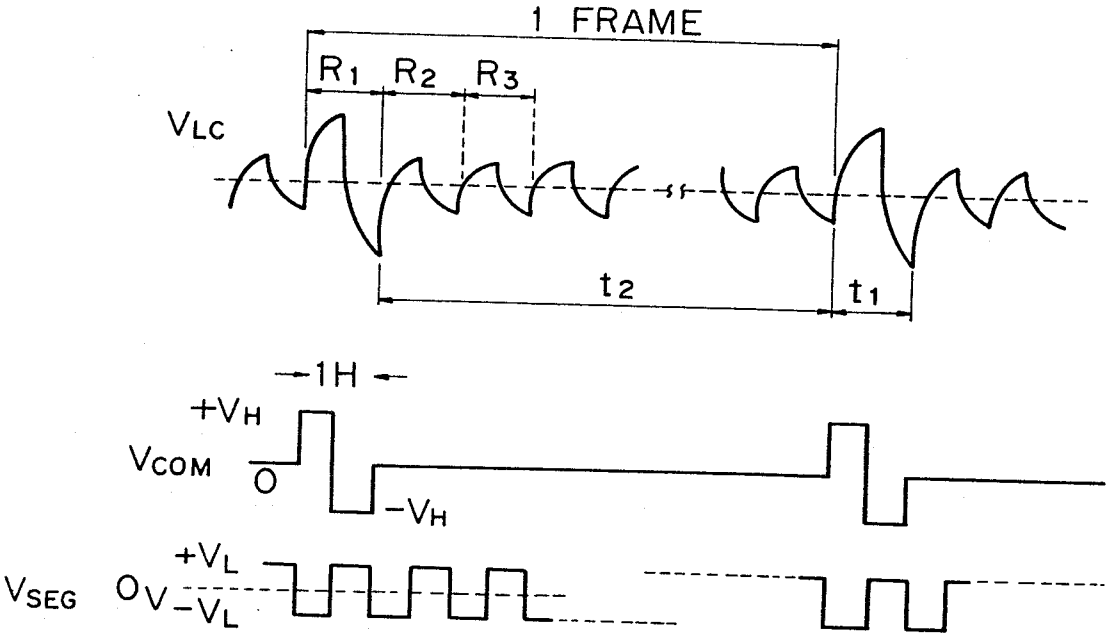
Fig. 3 (PRIOR ART)
FIG. 3 shows drive voltage waveforms for a prior art method of driving a liquid crystal matrix display panel, whereby the drive voltage applied to each display element is inverted once in each row selection interval.

It is necessary to periodically alternate the polarity of the drive voltage applied to each liquid crystal display element, i.e. no DC voltage component can be applied. One drive method known in the prior art, which meets the latter requirement, is shown in the timing chart of FIG. 3. With this method, the drive voltage applied to each display element is inverted midway through each row selection interval, that is, the positive drive state (as defined above) is established during the first half of each row selection interval, and the negative drive state during the second half. FIG. 3 shows the drive voltage applied during one frame interval to a display element which is addressed during row selection interval $R_1$, i.e. the selection interval $t_1$ for this display element corresponds to row selection interval $R_1$, while the non-selection interval ($t_2$) corresponds to the remaining row selection intervals of each frame interval. In the example of FIG. 3, all of the display elements of the column containing the addressed display element are set in the ON state. It will be apparent that if all of the other display elements in that column are set in the OFF state, then the drive voltage applied to the latter display element will be identical to that shown in FIG. 3, during the non-selection interval $t_2$, but will be shifted in phase by ½ of a row selection interval, i.e. by ½H.

With this drive method, no DC component is applied to a display element, and in addition, the number of transitions of potential of the drive voltage applied to a display element which occur in each frame interval will be independent of the display pattern formed by the other display elements of the column containing the latter display element. Thus, no pattern-dependent contrast variations will be produced, since the drive signal applied to each display element will contain substantially the same high-frequency components. However, due to the fact that a drive voltage polarity transition occurs in every row selection interval, the resistance-capacitance blocking effect which occurs with a large-area high element-density liquid crystal matrix display panel as described above will limit the amplitude of voltage applied to a display element which is to be set in the ON state, as illustrated for row selection interval $R_1$ in FIG. 3, i.e. the drive voltage will vary exponentially during each half of a row selection interval. This effect cannot be overcome by increasing the common or segment drive signal voltage levels, since this will produce an increase in the effective RMS voltage value applied during each non-selection interval. In addition, the high frequency components of the drive signals required with this method result in extremely high power consumption by the drive circuits of the display panel. For these reasons, it is not possible to apply this drive method to a large-area liquid crystal matrix display panel having a high display element density. The latter method will be referred to as the A-type drive method.

Figure 4A:
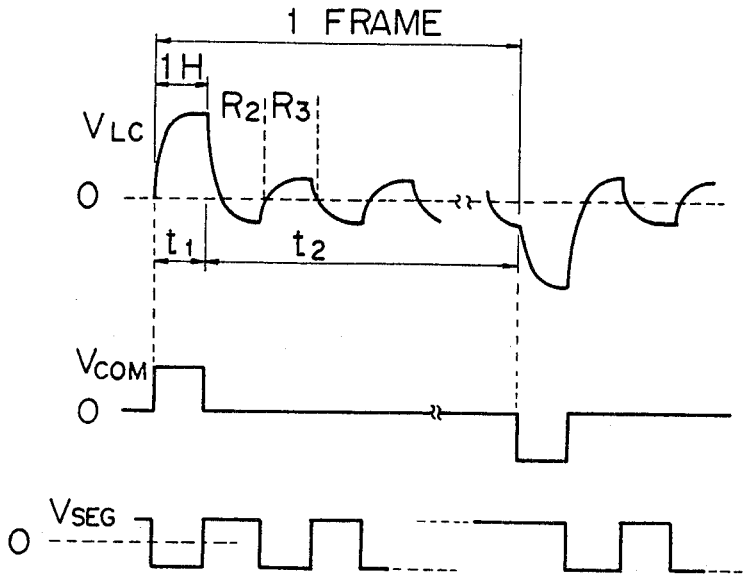
Fig. 4A (PRIOR ART)
FIG. 4A shows drive voltage waveforms for another prior art method of driving a liquid crystal matrix display panel, whereby the drive voltage applied to each display element is inverted in successive scanning frame intervals, for the case of a display element within a column of display elements in alternating dark and light states.
Figure 4B:
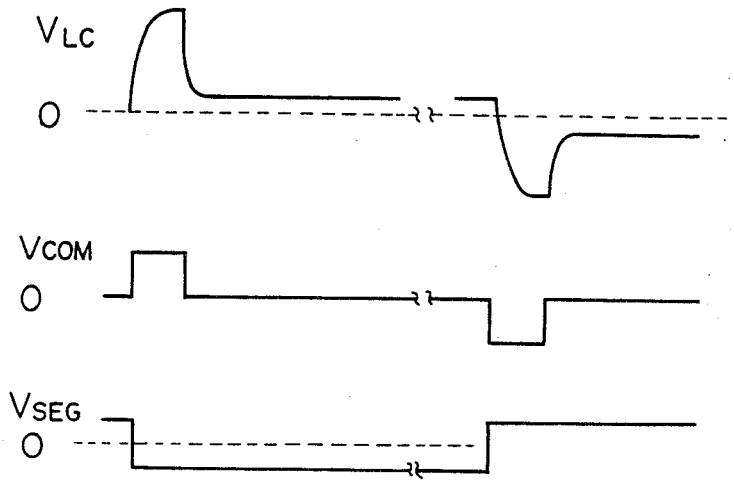
Fig. 4B (PRIOR ART)
FIG. 4B shows drive voltage waveforms for the method of FIG. 2B, for the case of a display element within a column of display elements which are all driven to the dark display state.

Another method of driving a liquid crystal matrix display panel known in the prior art will now be described, referring to FIG. 4A and 4B. With this method, which will be referred to as the B-type drive method, a drive voltage waveform $V_{LC}$ is employed whereby the polarity of the drive voltage applied to each display element alternates on successive frame intervals, i.e. the positive drive state and negative drive state (as defined hereinabove) are established alternately in successive frame intervals. As a result, no inversion of the polarity of drive voltage $V_{LC}$ applied to each display element during a row selection interval is performed, so that this method would appear to be more suitable than that of FIG. 3 for driving a large liquid crystal matrix display panel with high element-density. FIG. 4A shows the drive voltage waveforms $V_{COM}$ and $V_{SEG}$, and the resultant drive voltage $V_{LC}$ applied to the display element, for the case of a display element which is addressed during row selection interval and is set in the ON state, while the other display elements of the same column form a successive OFF-ON-OFF . . . pattern. The $V_{LC}$ waveform during the non-selection interval $t_2$ of this display element will therefore be of successively alternating form, as shown, i.e. being inverted on successive row selection intervals, and so contains a large high-frequency component. This drive signal waveform will also be applied to every display element in the same column as the latter display element, during each respective non-selection interval. In the case of a liquid crystal matrix display panel having a large number of display elements and high element density, then due to the drive conductor resistance display element capacitance effect described above, this high-frequency component of the $V_{SEG}$ waveform will be blocked, such as to provide only a relatively small contribution to the effective value of drive voltage applied to each display element of that column. FIG. 4B shows corresponding waveforms for this drive method, for the case of a display element addressed in row selection interval R1, which is set in the ON state, but with all of the other display elements in the same column of the array being also set in the ON state. In this case, the polarity of the drive signal $V_{LC}$ will be inverted only at the end of each frame interval, so that the drive voltage waveform during the non-selection interval $t_2$ contains a large low-frequency component, and this will be true for each of the other display elements within the same array column. This low-frequency component will be relatively unaffected by the resistance-capacitance blocking effect occurring in a large-area display as described hereinabove, and so will contribute a substantial amount to the effective drive voltage applied to a display element which is set in the ON state. However for the case of FIG. 4A, as described above, the drive voltage waveform contains a large high-frequency component, which is blocked from affecting the RMS value of $V_{LC}$. As a result, each display element in a column of display elements which are all set in the ON state (i.e. dark-level state) will attain a greater degree of dark-state density than each ON-state display element of a column of display elements which form an ON-OFF-ON-OFF . . . alternating pattern. As a result, unevenness of display quality will result. This pattern-dependence effect is a serious problem, which will of course be worsened as the number of display elements and display element density are increased, with corresponding increases in drive conductor resistance values.

It must be emphasised that the polarity of drive voltage applied to a display element during any row selection interval within the non-selection interval of that element within a frame interval will be determined by the combination of the display state (ON or OFF) to which the other element within the corresponding column, addressed during the latter row selection interval, is driven, and the drive state (positive or negative) established by the polarity control signal as described hereinabove. This relationship is illustrated in Table 1 below, in which $+_D$ denotes the positive drive state and $-_D$ the negative drive state, "1" denotes the ON state of a display element, and "0" the OFF state,

TABLE 1

| Drive state during row selection interval $R_n$ | $+D$ | | $-D$ | |
|---|---|---|---|---|
| State of display element addressed during $R_n$ | 1 | 0 | 1 | 0 |
| Polarity of drive voltage applied during $R_n$ to any other (i.e. non-addressed) element in same column. | + | − | − | + |

Figure 5A:
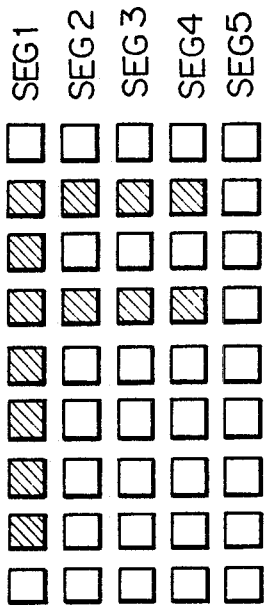
FIGS. 5A and 5B are diagrams illustrating contrast irregularity produced by a prior art drive method for the case of a pattern representing the letter F being displayed by a liquid crystal matrix display panel.
Figure 5B:
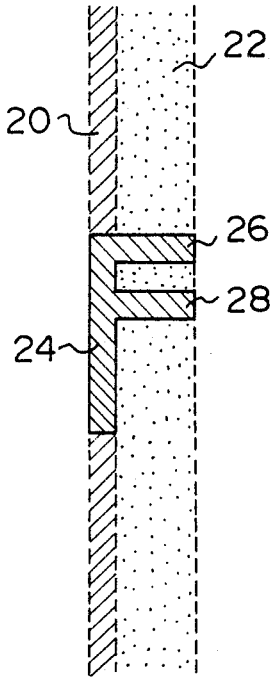

This display pattern dependency problem which arises with the B-waveform drive method is illustrated in FIGS. 5A and 5B. Here, the capital letter F is displayed vertically, with the vertical bar portion of the letter being formed by a set of 7 display elements which are driven by a segment conductor denoted as SEG1. Thus, these 7 display elements are held in the ON state. The remaining portions of the letter are formed by alternating ON and OFF states of three other columns of display elements, driven respectively by segment conductors designated as SEG2, SEG3 and SEG4. As illustrated in FIG. 5B, Using the B-waveform drive method described above with a large display having high element density, the vertical bar portion 24 of the letter will appear darker than the horizontal portions 26, 28. In addition, since a relatively large drive voltage component will be applied to each display element of the column containing vertical bar 24 which are set in the OFF state, due to a low-frequency component of the drive signal applied to each of these display elements being produced as described hereinabove, these display elements will not be set completely in the OFF (i.e. light) state, but will be driven to some extent into the ON state, so that they will appear darker than adjacent OFF state display elements on each side of that column, as indicated by numeral 20. Thus, a grey vertical band will appear in the column containing vertical bar portion 24. If a number of such vertical bar portions occur within the same array column, then this vertical band will become of correspondingly darker appearance than the display background color. A corresponding effect occurring in vertically aligned region 22, corresponding to horizontal bar portions 26, 28, will be much less apparent, due to the blocking effect of drive signal high frequency components described above.

The basic concepts of the method of the present invention will now be described. Firstly, referring again to FIG. 4A, and examining the non-selection interval $t_2$ of a display element which is addressed during row selection interval $R_1$, there are four possible modes of drive voltage polarity transition (referred to in the following as polarity alternation sub-sequences) which can occur during any successive pair of row selection intervals within this interval $t_2$. These are, for example in the case of row selection intervals R2 and R3 in FIG. 4A, a sequence of negative polarity during R2 and positive polarity during R3 (as in FIG. 4A), a sequence of two intervals of positive polarity, during R2 and R3, (i.e. as in FIG. 4B), a sequence of positive polarity during R2 and negative polarity during R3, and a sequence of two intervals of negative polarity, i.e. during both R2 and R3. It is a fundamental feature of the present invention that, for any such pair of consecutive row selection intervals during the non-selection intervals of any display element, all of the above sequences of drive voltage polarity alternation will occur during each of consecutively occurring sets of four consecutive frame intervals. As a result, the total number of drive voltage polarity alternations which occur during the non-selection intervals of a display element, as measured over such a set of four consecutive frame intervals, will be constant, irrespective of the display pattern formed by the other display elements of that array column.

The manner in which is is accomplished will now be described, referring first to FIG. 6. With the present invention, the drive voltage applied to any mutually adjacent pair of display elements in an array column, during the two successive row selection intervals in which these display elements are respectively addressed in each frame interval, is controlled in accordance with four different subsequences respectively in every four successive frame intervals. These drive voltage control sub-sequences are designated as $as_0$ to $ss_3$ in FIG. 6. With $ss_0$, the positive drive state (ss defined hereinabove) indicated as $+_D$, is applied during both of the abovementioned two successive row selection intervals (designated as $R_N$ and $R_{N+1}$). With $ss_1$, the negative drive state (as defined hereinabove and indicated as $-_D$) is applied during both $R_N$ and $R_{N+1}$. With $ss_2$, the positive drive state is applied during $R_N$ and the negative drive state during $R_{N+1}$. With $ss_3$, the negative drive state is applied during $R_N$ and the positive drive state during $R_{N+1}$. Each of these four sub-sequences is implemented times in each of successive groups of frame intervals, which will be referred to as cycle intervals, with each cycle interval consisting of 4 successive frame intervals, where is an integer. The four subsequences occur in a fixed order within each cycle interval, which can be arbitrarily determined. The length of each cycle interval is preferably made equal to 4 frame intervals, and this value will be assumed in the following unless otherwise stated.

Figure 7:
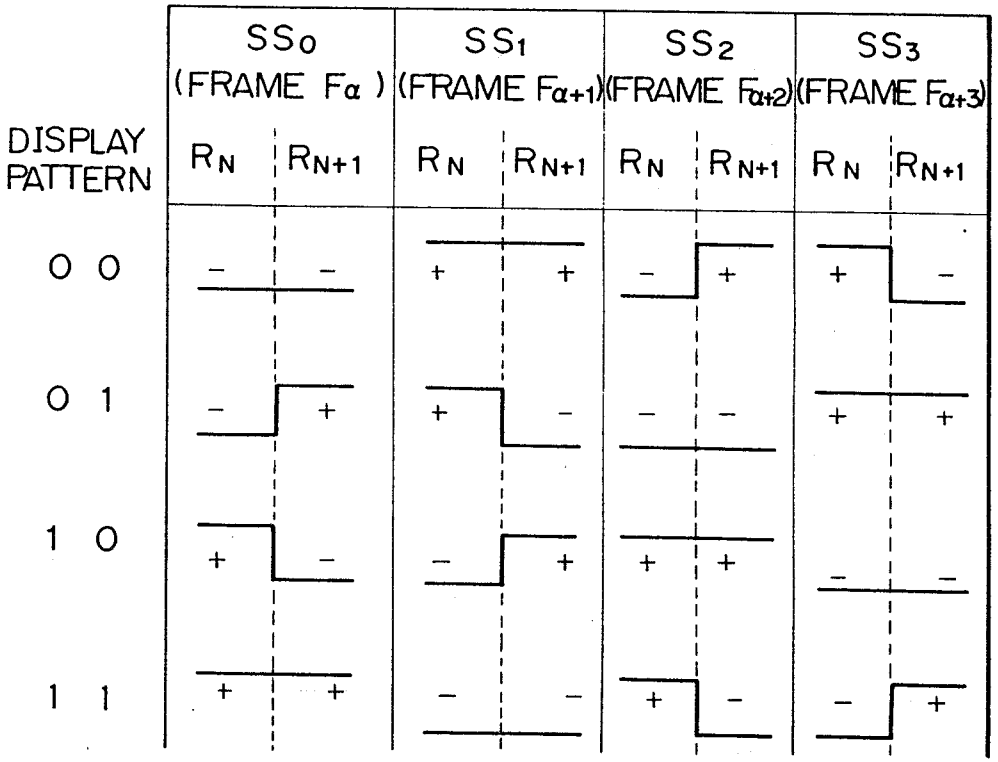

The effect obtained by this procedure are illustrated in FIG. 7. This is a table which shows the voltages (e.g. $+V_L$ or $-V_L$ in the example of FIGS. 2C, 2D) which are applied during row selection intervals $R_N$ and $R_{N+1}$, for four successive frame intervals $F_a$ to $F_{a+3}$, to any display element which is not addressed during either of the latter intervals. The table shows how these non-selection applied voltages vary in accordance with the display pattern produced by the two display elements which are in the same column as the latter display element and which are addressed during intervals $R_N$, $R_{N+1}$ respectively in each frame interval. For example, if display elements **16*b*, 16*c* in FIG. 1 are addressed during $R_N$, $R_{N+1}$, then the column "Display pattern" in FIG. 7 indicates the display patterns which can be produced by these two elements, and the table shows the resultant voltages which will be applied to a non-addressed element (e.g. element 16*a*) during four successive frame intervals. It is assumed that the drive voltage polarity alternation sub-sequences are applied to these two display elements in the order $ss_0$, $ss_1$, $ss_2$ and $ss_3$ in the four successive frame intervals of each cycle interval. In FIG. 7, the application of a positive polarity drive voltage during a non-selection interval is indicated by the + symbol (e.g. corresponding to application of voltage $+V_L$ in the example of FIG. 2C above) and the application of a negative polarity drive voltage during the non-selection interval is indicated by the "−" symbol (e.g. corresponding to voltage $-V_L$ in the example of FIG. 2C). The ON state of a display element is indicated as 1, and the OFF state as 0. The case in which the display pattern produced by the two adjacent display elements addressed during intervals $R_N$, $R_{N+1}$ is 00 (i.e. both display elements are set to the OFF state) will be described first. During the first frame interval of a cycle interval, (indicated as frame 4N**), when $ss_0$ is established, negative polarity drive voltage (e.g. $-V_L$) will be applied to each non-addressed display element within the column concerned, during both of row selection intervals $R_N$ and $R_{N+1}$. During the next frame interval, (when sub-sequence $ss_1$ is established) the positive polarity drive voltage (e.g. $+V_L$) will be applied to each non-addressed display element in that column, during both $R_N$ and $R_{N+1}$. During the third frame interval of the cycle interval (in which subsequence $ss_2$ is established) the negative drive voltage will be applied during $R_N$ and the positive drive voltage during $R_{N+1}$. During the fourth frame interval of the cycle interval (in which sub-sequence $ss_3$ is established), the negative drive voltage will be applied during $R_N$ and the positive drive voltage during $R_{N+1}$. It can thus be seen that for a display pattern consisting of two OFF state display elements disposed mutually adjacent in a matrix column, a total of four alternations of drive voltage polarity will occur during the non-selection intervals of every other display element in the column containing the latter two display elements, as measured over four consecutive frame intervals.

It will be apparent that the same will be true for each of the other three possible display states produced by these two display elements, indicated as 01, 10 and 11 in FIG. 7. Thus, since any display pattern formed by a column of display elements must consist of combinations of the four patterns 00, 01, 10 and 11, the number of polarity alternations of drive voltage which take place during the non-selection intervals of any display element, as measured over any four successive frame intervals with this embodiment, will be independent of the display pattern formed by that column.

Figure 8A:
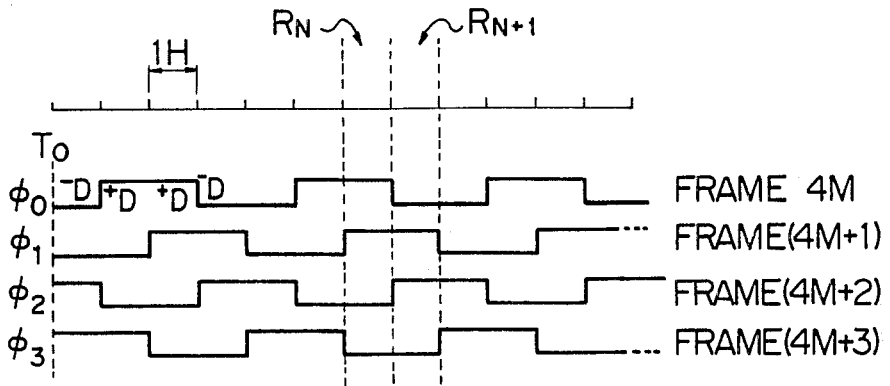
FIGS. 8A, 8B and 8C are diagrams illustrating drive voltage polarity alternation sequences for embodiments of the present invention, for the case of a cycle interval value of 4 frame intervals being utilized.
Figure 8B:
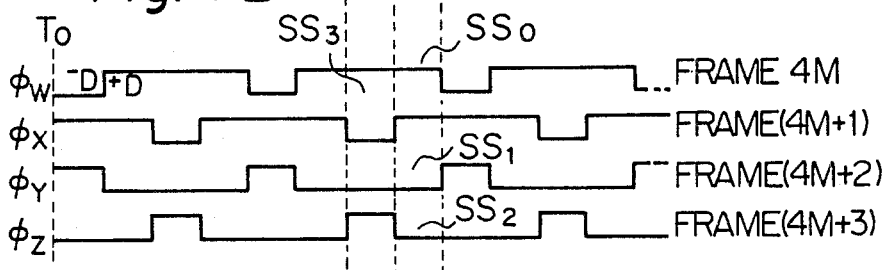
Figure 8C:
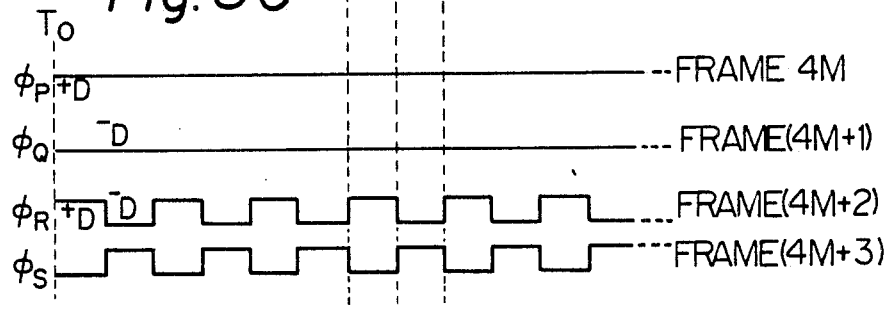

Three possible methods of drive voltage control to implement the above drive voltage sub-sequences are illustrated in FIGS. 8A, 8B and 8C, in which waveforms of the polarity control signal referred to above are shown, with it being assumed as stated above that the positive drive state is produced when the polarity control signal is at a high potential, and the negative drive state when the polarity control signal is at a low potential. Firstly, with the method shown in FIG. 8A, four waveforms of the polarity control signal having an identical period, which mutually differ in phase and are designated as $\phi 0$ to $\phi 3$, are applied respectively during the four successive frame intervals of each cycle interval. For comparison of the phase relationships of these four waveforms, each is shown as beginning at a fixed timing $T_0$ which is arbitrarily determined with respect to the start of a frame interval. Each waveform comprises a periodic repetition of two row selection intervals in which the positive drive state (high potential of the polarity control signal) is established followed by two row selection intervals in which the negative drive state (i.e. low potential of the polarity control signal) is established. As shown, these four waveforms $\phi 0$ to $\phi 3$ respectively differ from one another in phase by 1H. That is, waveforms $\phi 1$, $\phi 2$, $\phi 3$ differ in phase by one, two and three row selection intervals respectively from waveform $\phi 0$. Thus for any pair of adjacent display elements in the same column, i.e. the pair addressed during successive row selection intervals $R_N$, $R_{N+1}$ in FIG. 8A, the four drive state subsequences $ss_2$, $ss_0$, $ss_3$ and $ss_1$ described hereinabove will be cyclically repeated in each of successive sets of four frame intervals. The order in which $\phi 0$ to $\phi 3$ are repeated in successive frame intervals of the 4-frame cycle interval can be arbitrarily determined, but must be fixed.

FIG. 9B shows another example of this embodiment, with a different set of polarity control signal waveforms $\phi W$ to $\phi Z$ being established during four successive frame intervals of each cycle interval. Each of these waveforms comprises a periodically repeated combination of positive and negative drive states, with a period of 4H. During waveform $\phi W$, the negative drive state (low potential of the polarity control signal) is established during the first row selection interval of a period, then the positive drive state (high potential of the polarity control signal) is established during the remaining three row selection intervals of the period. During waveform $\phi X$ the positive drive state is established during the first two row selection intervals of period, the negative drive state during the third row selection interval, and the positive drive state during the fourth row selection interval. During waveform $\phi Y$, the positive drive state is established during the first row selection interval of a period, and the negative drive state is established during the remaining three row selection intervals of the period. During waveform $\phi Z$, the negative drive state is established during the first two row selection intervals of a period, the positive drive state during the third row selection interval of that period, and the negative drive state during the fourth row selection interval of the period. The above description assumes a period which begins at arbitrarily determined reference timing $T_o$ in FIG. 8B.

If the order of occurrence of these four waveforms $\phi W$, $\phi X$, $\phi Y$ and $\phi Z$ is as shown in FIG. 8B, the subsequences $ss_0$, $ss_3$, ss 1 and $ss_2$ will be successively established in successive frame intervals of a cycle interval.

FIG. 8C shows another embodiment of the method of the present invention, in which the polarity control signal is held fixed at a high potential during one frame of each cycle interval (e.g. as indicated by $\phi P$), is held fixed at a low potential during another frame of the cycle interval, has a waveform which alternates between the low and high potentials during successive row selection intervals of a third frame of the cycle interval (e.g. $\phi R$), and has a waveform which alternates between the low and high potentials during the remaining frame of the cycle interval ($\phi S$), and differs in phase from waveform $\phi R$ by one row selection interval.

In the embodiments described above, a cycle interval of four successive frame intervals is utilized. It is preferable to keep the duration of the cycle interval as short as possible, i.e. to achieve averaging of the number of drive voltage polarity transitions occurring for each display element within a short time interval. This is due to the fact that if the cycle interval is held to less than the the response time of the liquid crystal (i.e. the maximum time during which switching the drive voltage between the ON and OFF states will produce no perceptible visible effect), then no visible flicker will appear on the display as a result of utilizing the drive method of the present invention. With the liquid crystal materials in general use at present, this response time is approximately 80 milliseconds. Thus, using a frame repetition frequency of 70 Hz and a 4-frame cycle interval, no flickering of display pattern contrast or density will be visible.

Figure 9:
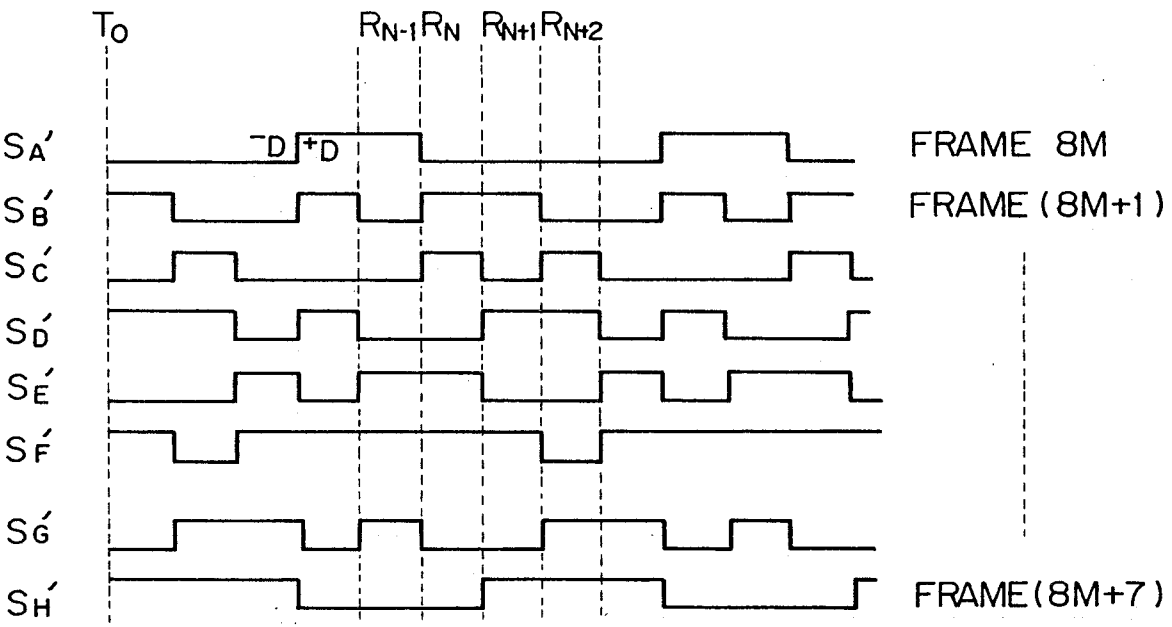
FIG. 9 is a diagram illustrating drive voltage polarity alternation sequences for an embodiment of the present invention in which a cycle interval value of 8 frame intervals is utilized.

The present invention is however not limited to the case of a cycle interval of 4 frame intervals. FIG. 9 illustrates another embodiment in which a cycle interval of 8 frame intervals is employed. In this example, 8 different sequences of drive voltage polarity alternation are established respectively in the 8 frame intervals of each cycle interval, designated as $S_A'$ to $S_H'$. As shown, each of the drive state sub-sequences $ss_0$ to $ss_3$ described above will occur twice in each 8-frame cycle interval, for the drive voltages applied to any pair of display elements which are addressed successively in each frame interval, e.g. a pair which are addressed successively during row selection intervals $R_N$ and $R_{N+1}$ in each frame interval.

It can thus be understood that the method of the present invention is based upon the use of a polarity control signal which has a different waveform during the respective frame intervals of each cycle interval, (each cycle interval comprising 4M successive frame intervals), where the polarity control signal is a signal which, when set to a first potential, causes a positive polarity to be applied to a currently addressed display element and which, when set to a second potential, causes a negative polarity to be applied to a currently addressed display element. These waveforms are selected such that for any specific row selection interval in any set of 2M successive row selection intervals $R_N$, . . . $R_{N+(2M-1)}$ occurring at identical timings in each frame (e.g. intervals $R_N$, $R_{N+1}$ in FIG. 8, or $R_{N-1}$, . . . $R_{N+2}$ in FIG. 9), the polarity control signal is set to the first potential during a total of ½ of the occurrences of that specific row selection interval within a cycle interval, and is set to the second potential during the other ½. For example, during interval $R_N$ in FIG. 8A, the polarity control signal goes to the high potential during frame intervals 4M and (4M+1) and to the low potential during (4M+2) and (4M+3), while in FIG. 9, during interval $R_N$, the polarity control signal goes to the high potential during frame intervals (8M+1), (8M+2), (8M+4), (8M+5), and to the low potential during 8M, (8M+3), (8M+6) and (8M+7). In addition, for any specific row selection interval in the above set of 2M successive row selection intervals, the frame-by-frame sequence whereby transitions in potential of the polarity control signal occur duffers from that of each of the other row selection intervals within that set. For example in FIG. 8A, the polarity control signal varies in a frame-by-frame sequence of +, +, −, − during row selection interval $R_N$, in each cycle interval, and varies in the sequence −, +, +, − during interval $R_{N+1}$ in each cycle interval. Similarly, the sequences of potential transitions of the polarity control signal are respectively different, e.g. during row selection intervals $R_N$ and $R_{N+1}$, within each cycle interval, for the 4-frame cycle interval examples shown in FIGS. 8B and 8C, and the 8-frame cycle interval example of FIG. 9. It is as a result of this control of the polarity control signal waveforms that each of the four drive voltage polarity state subsequences described above is implemented M times in each cycle interval. where M is an integer. Generally speaking, the cycle interval should be as short as possible, i.e. M should preferably be made equal to 1.

Figure 10A:
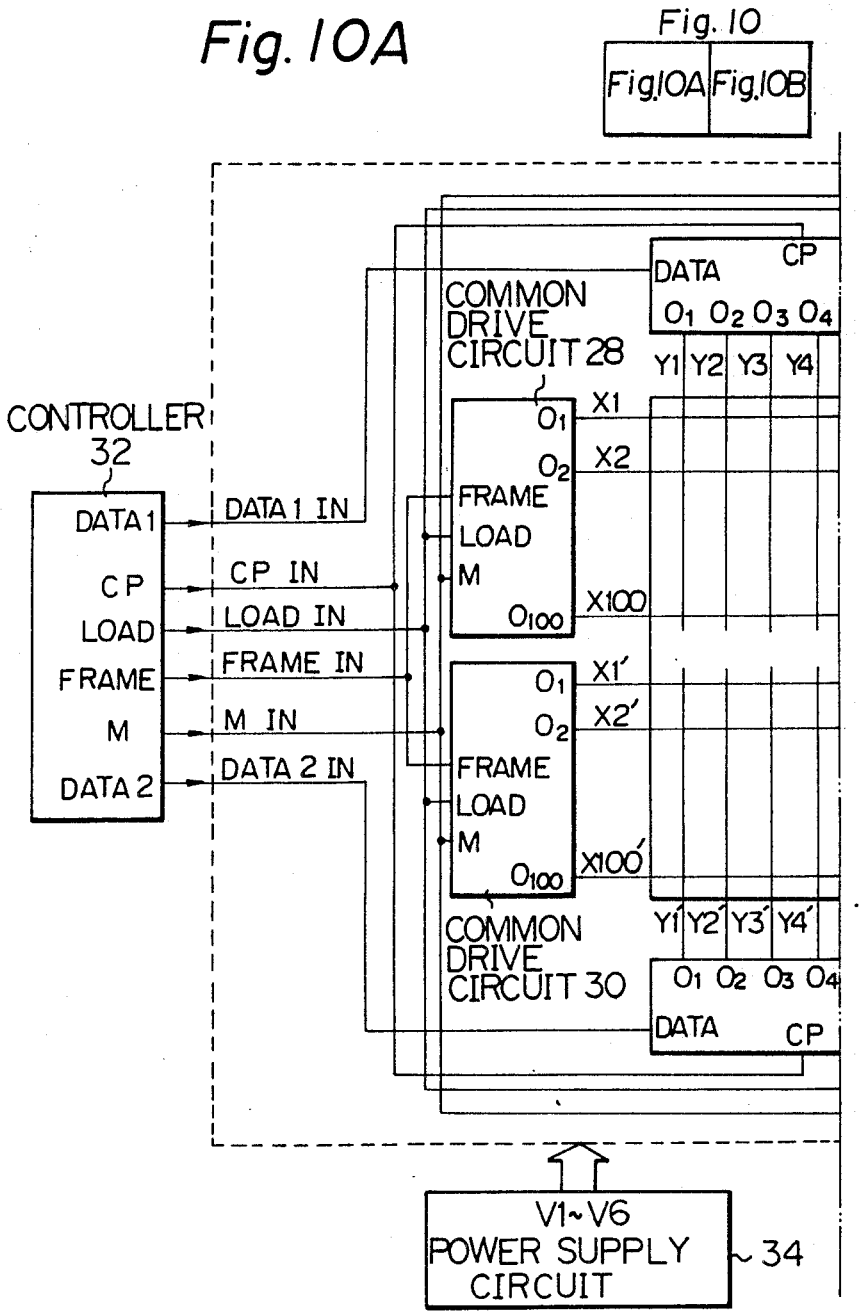
FIGS. 10A, 10B is a block circuit diagram of a a liquid crystal matrix display panel with associated drive circuits and art control circuit.
Figure 10B:
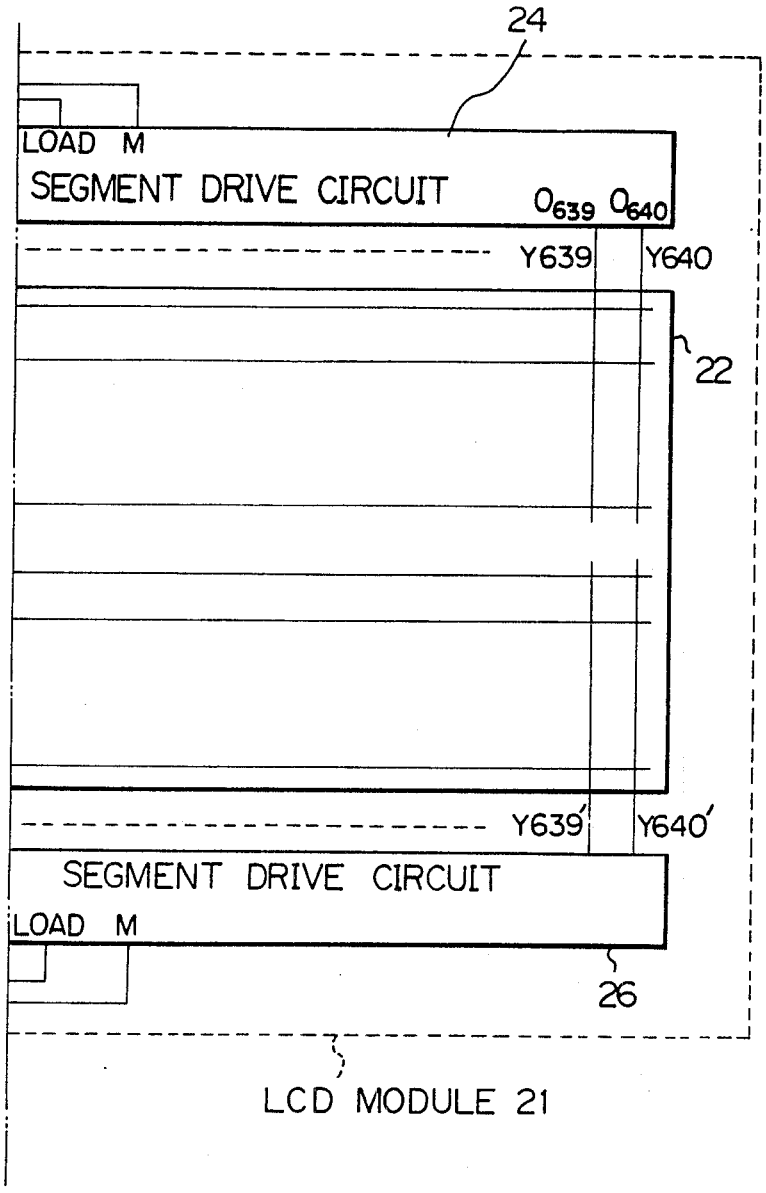

FIG. 10 is a general block circuit diagram of a liquid crystal matrix display panel and peripheral drive circuits of the type utilized for prior art drive methods, e.g. for applying drive signals of the A or B-waveform type described hereinabove. In this example, in order to increase the duty ratio for which each display element is driven, the display panel 22 is divided into upper and lower sections, each comprising an identical number of display elements. The upper section is driven by segment conductors $Y_1$ to $Y_{648}$ and common conductors $X_1$ to $X_{100}$, while the lower section is driven by segment conductors $Y'_1$ to $Y'_{648}$ and common conductors $X'_1$ to $X'_{100}$. Due to this division of the display panel, and simultaneous addressing of one common conductor in the upper half and one in the lower half, the duty ratio for which each display element is driven is 1/100, although the total number of display elements is 640×200. Numerals 24 and 26 respectively denote segment drive circuits for driving the segment conductors ($Y_1$ to $Y_{640}$) and ($Y'_1$ to $Y'_{640}$), while numerals 28 and 30 respectively denote common conductor drive circuits for driving the common conductors ($X_1$ to $X_{100}$) and ($X'_1$ to $X'_{100}$). Numeral 32 denotes a controller which receives data as input and produces corresponding drive signals to be applied to common drivers 28, 30 and to segment drive circuits 24 and 26. A power supply circuit 34 produces the necessary voltages for generating the $V_{seg}$ and $V_{com}$ drive signals.

Figure 11A:
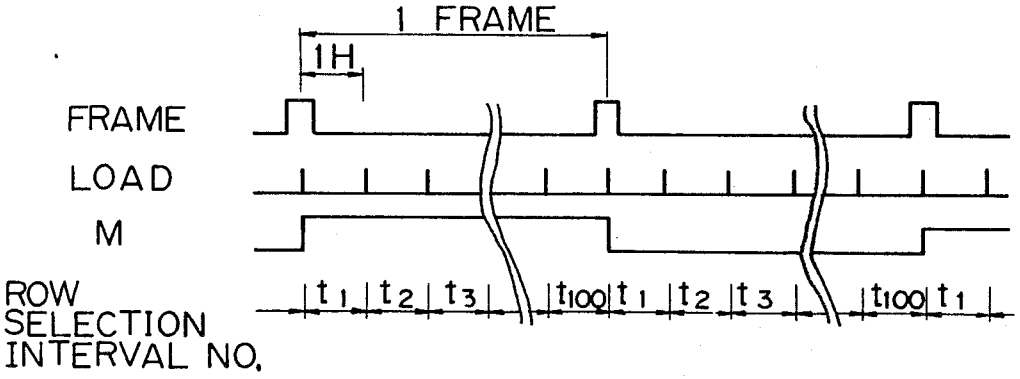
Fig. 11A (PRIOR ART)
FIGS. 11A and 11B are timing charts to illustrate the operatio of the block circuit diagram of FIG. 10.
Figure 11B:
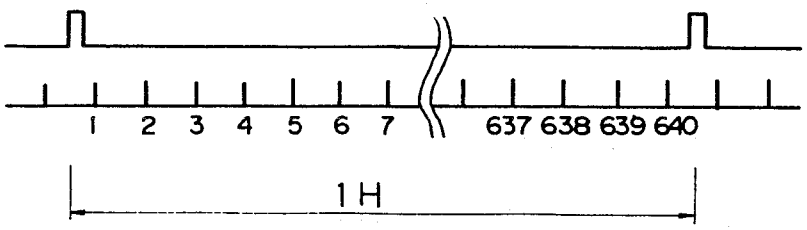
Figure 12:
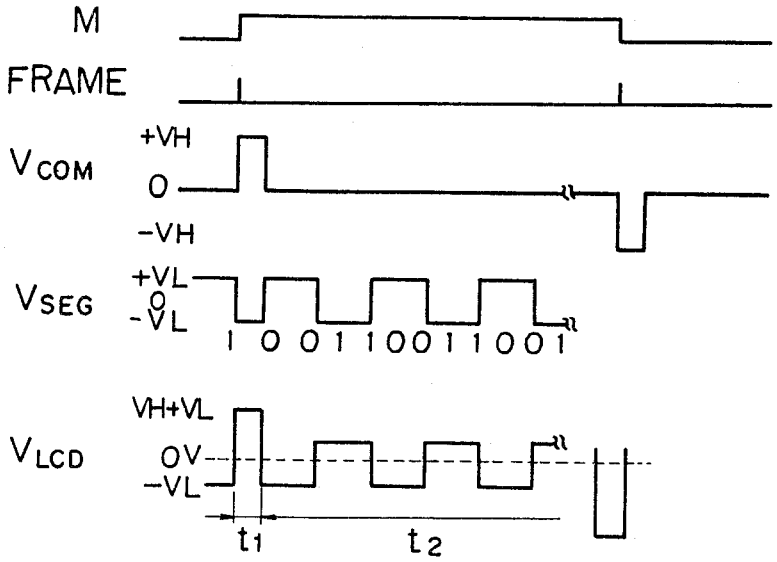
Fig. 12 (PRIOR ART)
FIG. 12 is a timing chart to illustrate a prior art drive method as applied to the liquid crystal matrix display panel of FIG. 10.

Controller 32 produces display data DATA 1 corresponding to each horizontal line of display data for the upper display section and DATA 2 corresponding to each line of display data for the lower display section to the display panel. DATA 1 and DATA 2 are respectively input in serial form to shift registers within segment drive circuits 24 and 26, in synchronism with a clock pulse signal CP. Each time data representing a complete line has been transferred into segment drive circuits 24 and 26, a LOAD signal pulse is output from controller 32, as illustrated in the timing chart of FIG. 11A. In response to this pulse, the data thus transferred become stored in memory circuits within the segment drive circuits. The segment drive circuits produce segment drive signals corresponding to this stored data, from output terminals $O_1$ to $O_{640}$. The time taken for one line of display data to be stored in each of segment drive circuits 24 and 26 (equivalent to 640 clock pulses, i.e. the repetition period of the LOAD signal pulses) is equal to the duration of one row selection interval, 1H. Frame signal pulses are input to common conductor drive circuits 28 and 30, synchronized with the timing of the LOAD signal pulses, i.e. the LOAD signal pulses serve as clock pulses for this read-in operation. The time taken for 100 LOAD signal pulses to be produced, i.e. the scanning period of each common conductor, is one frame interval. Signal M is a polarity control signal, which controls the polarity of drive signal applied during each row selection interval. In this example, a positive drive state (as defined hereinabove) is established while signal M is at a high logic level (H level) and a negative drive state is established while signal M is at the low (L) logic level, so that the H and L levels respectively correspond to the positive drive state $+_D$ and negative drive state $-_D$ defined hereinabove. FIG. 11*a* shows the waveform of signal M when the B waveform type of prior art drive method (described hereinabove with reference to FIGS. 4A, 4B) is used. In this case, the potential of signal M alternates between the H and L levels in successive frame intervals. FIG. 12 illustrates the relationships between segment and common drive signal potentials for this embodiment, for the case of a column of display elements displaying a repetitive 110011001100 . . . pattern.

If signal M were to change in potential once in every ½ H intervals, then the A waveform described hereinabove would result.

Figure 13:
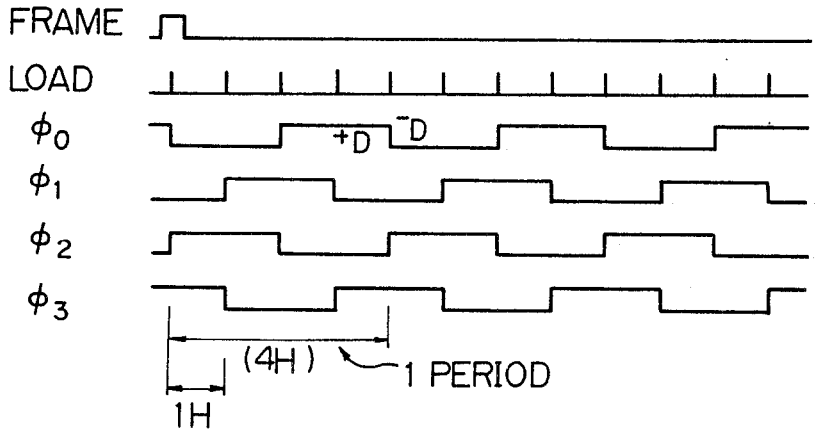
FIGS. 13 and 14 timing charts to illustrate the application of an embodiment of the method of the present invention to the display system of FIG. 10.

Application of the drive method of the present invention to the apparatus of FIG. 10 will now be described, referring first to the timing chart of FIG. 13. In this example, the drive voltage waveforms $\phi_0$ to $\phi_3$, with a cycle interval of 4 frame intervals, are utilized as described hereinabove with reference to FIG. 8A, i.e. with each of waveforms $\phi_0$ to $\phi_3$ being respectively maintained during a corresponding frame interval in each cycle interval. As in the prior art examples described above, a frame pulse is produced at the start of each frame interval, and a load pulse at the start of each selection interval.

Figure 14:
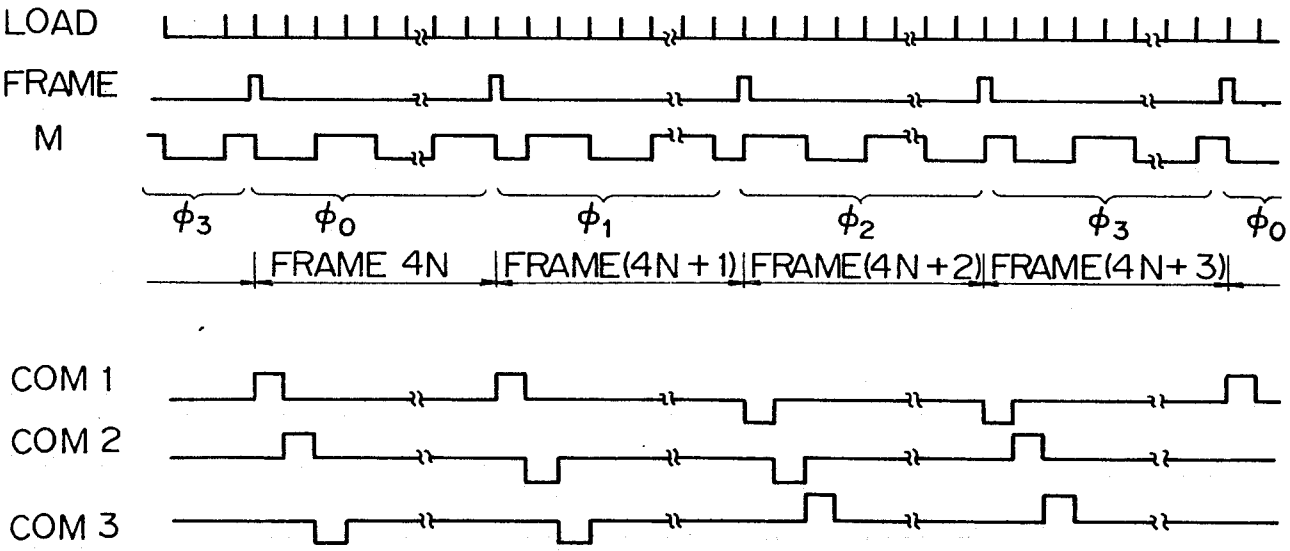

FIG. 14 shows the relationship between the sequences of occurrence of waveforms $\phi_0$ to $\phi_3$ of polarity control signal M and the common drive signals COM 1 to COM 3, for four successive frame intervals, i.e. one cycle interval. As stated hereinabove, it is not essential that this order of occurrence of waveforms $\phi_0$ to $\phi_3$ in the successive frame intervals of each cycle interval be followed so long as this order is fixed. The liquid crystal display element drive waveform which results from use of a polarity control signal waveform M as described above will be designated as the C waveform.

Figure 15:
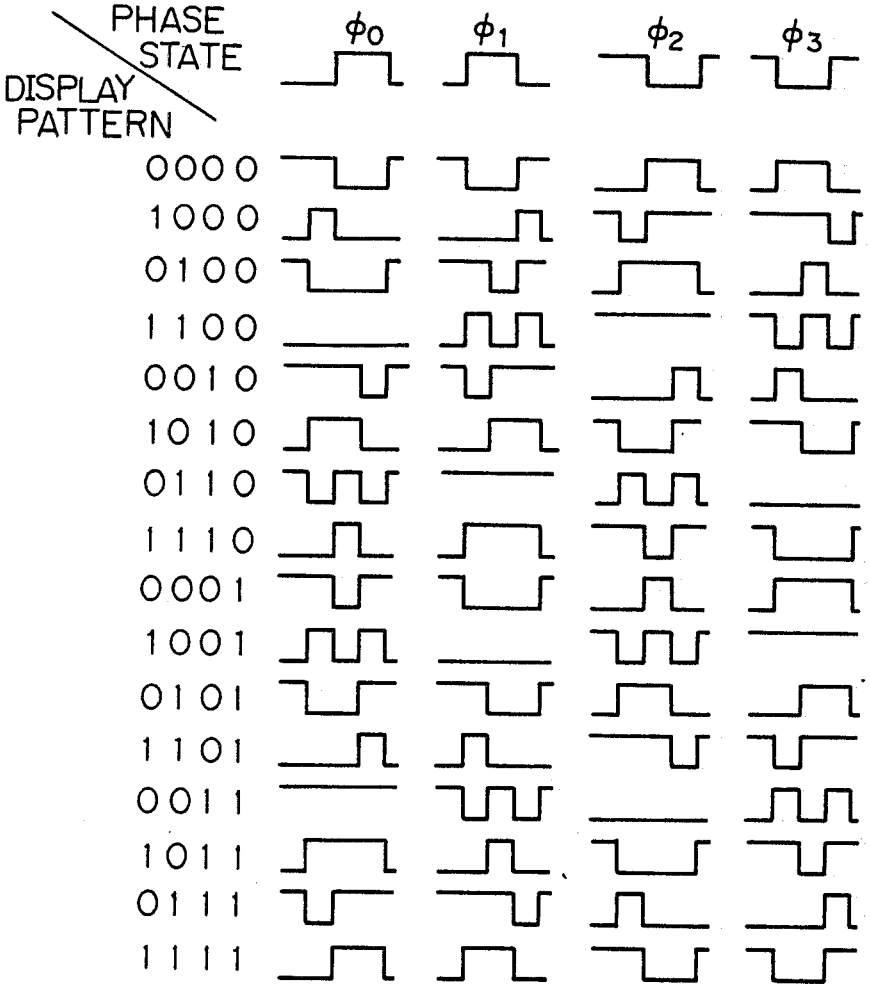
FIG. 15 is a diagram for illustrating the manner in which display pattern dependency of the frequency components in a segment conductor drive signal is substantially entirely eliminated by the method of the present invention, for the case of a cycle interval of 4 frame intervals.

FIG. 15 shows the drive signal waveforms which will be applied during each non-selection interval of a display element in a column of the display, with this embodiment, for each of the possible display states 0000 to 1111 of four other display elements which are successively positioned in that column, i.e. which are disposed successively adjacent and are all driven by the same segment drive conductor. In FIG. 9, the "0" state indicates the OFF (e.g. "light") state of a display element, while the "1" state denotes the ON (e.g. "dark") state of a display element. It is only necessary to consider four successively adjacent display elements, since the period of signal M is equal to four horizontal selection intervals, as stated above. That is to say, if an entire vertical column of display elements is in the OFF state, then the $\phi_0$ waveform state will be applied as the segment drive signal to the segment conductor of that column during one frame interval, the $\phi_1$ waveform will be applied to that segment conductor during the next frame interval, the $\phi_2$ waveform will be applied during the next frame interval, the and the $\phi_3$ waveform will be applied during the next frame interval, then the $\phi_0$ waveform will be again applied during the succeeding frame interval, and so on. It is a unique feature of the method of the present invention that, as can be seen from FIG. 9, that the number of transitions of polarity of the drive voltage applied to any display element during the non-selection intervals of that display element occurring within each cycle interval (e.g. four successive frame intervals) is independent of the display pattern. In the case of the prior art drive method described hereinabove with reference to FIGS. 4A and 4B, however, the number of alternations of polarity of the drive voltage applied during the non-selection interval of a display element will depend upon the display pattern formed by the display elements of the corresponding array column, so that the problem of pattern-dependent display density and contrast variations occurs, with a large-area high-density display. However as will be clear from FIG. 15, the method of the present invention will ensure that the proportion of high and low frequency components of the drive signal applied to each display element will be substantially pattern-independent, since the number of drive voltage polarity transitions occurring within a fixed periodically repeated time interval (the cycle interval, in the above example equal to four frame intervals) is constant. Evenness of the proportions of high and low frequency components of the drive signal is ensured by the manner in which the polarity transitions are distributed within each cycle interval, i.e. in the example of FIG. 15, if a set of four successive row selection intervals occurs within a frame interval with no drive voltage polarity transition occurring during these row selection intervals, then four polarity transitions will occur during these four row selection intervals in the succeeding frame (e.g in the case of pattern 1100).

In order to obtain the advantages described above, it is necessary that the essential conditions of the present invention be satisified as described hereinabove, with respect to the four drive voltage polarity alternation sub-sequences.

Figure 16A:
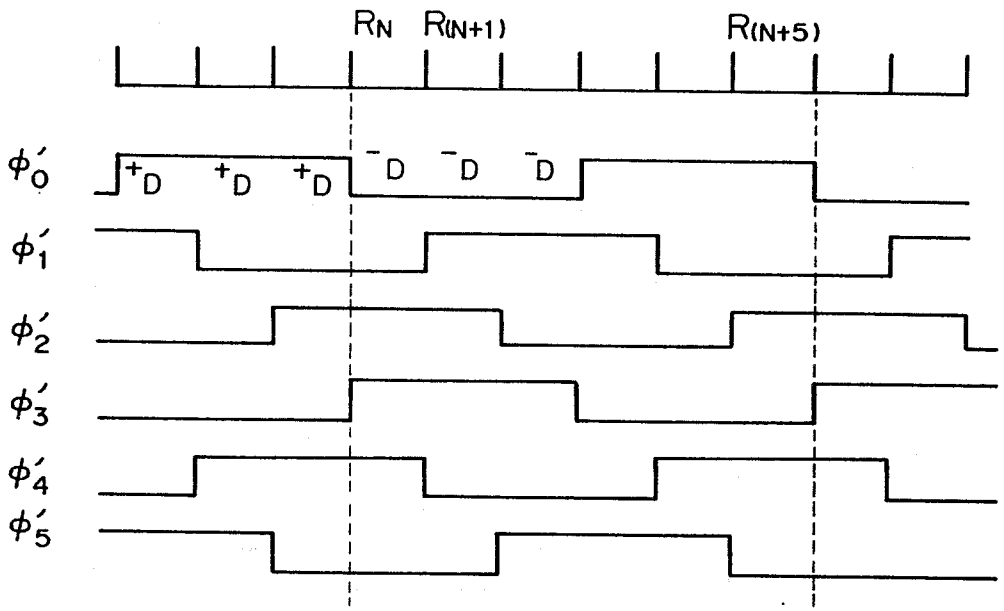
Fig. 16A (PRIOR ART)
FIGS. 16A and 16B are diagrams for illustrating the manner in which pattern dependency of drive signal frequency components arises with a proposed prior art method having similar objectives to the present invention.
Figure 16B:
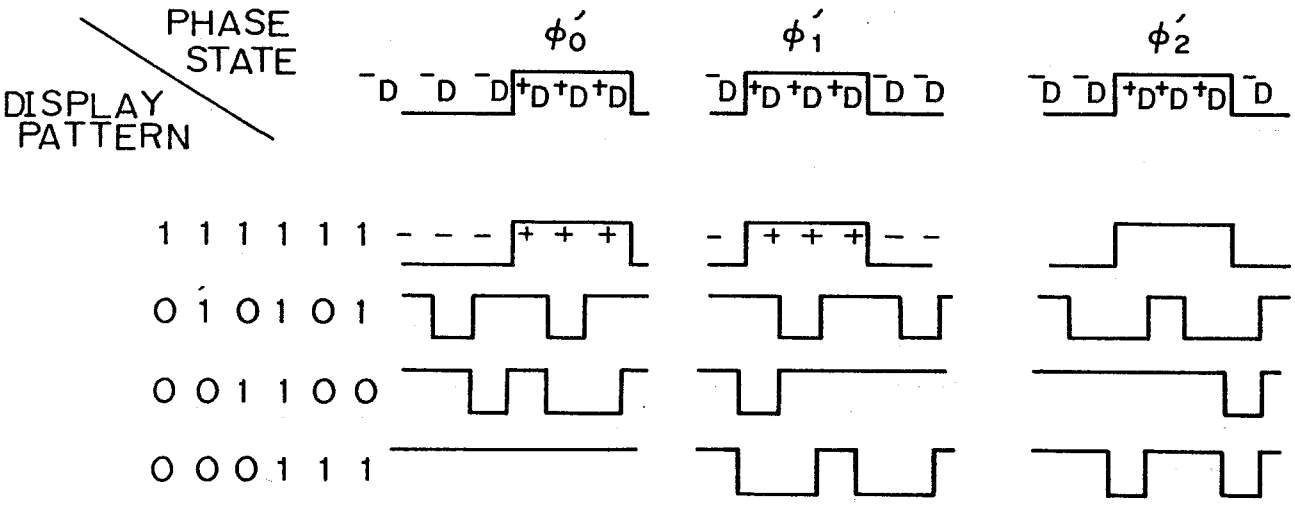

To illustrate this, a drive method will be examined which appears superficially similar to the method of the present invention but is in fact not effective for all display patterns. This is the drive method embodiment given in the SID Japan paper referred to hereinabove. Six drive voltage waveforms are implemented in each of successive frame intervals of a 6-frame interval cycle interval, these being designated as $\phi_0'$ to $\phi_5'$ in FIG. 16A. Since the waveforms $\phi_3'$ to $\phi_5'$ are the respective inverses of the waveforms $\phi_0'$ to $\phi_2'$ respectively, it is only necessary to consider one-half of the cycle interval to examine the pattern dependency of drive voltage polarity alternations produced by this method (i.e. during the non-selection interval of a display element). This is illustrated in FIG. 16B. As shown, for a display pattern portion consisting of 6 successively adjacent display elements in an array column, if the pattern is 010101 (where 0 and 1 have the significances described previously) then a total of 12 drive voltage polarity transitions will occur in every three successive frame intervals when these display elements are driven. However if the pattern is 111111, then only 6 polarity transitions will occur. Thus, this prior art proposed drive method does not provide the desired freedom from pattern dependence, that is to say, the average frequency of drive voltage polarity transitions which occur during the non-selection intervals of each display element will be strongly affected by the display pattern produced by the other display elements within the same column. The reason for this is apparent from FIG. 16A, i.e. during any two row selection intervals e.g. $R_N$, $R_{N+1}$, the sub-sequences described hereinabove do not occur in equal numbers within the 6-frame cycle interval, so that the basic conditions set by the present invention are not satisfied.

Figure 17A:
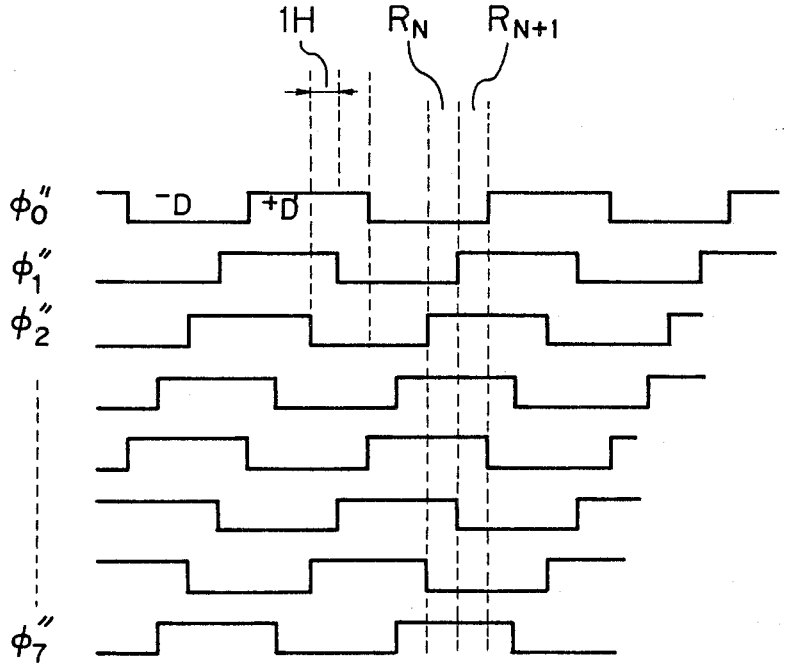
FIGS. 17A and 17B are diagrams for illustrating how pattern dependency of display contrast will arise with a drive method employing successive drive voltage polarity alternation, which does not meet the essential requirements set by the present invention.
Figure 17B:
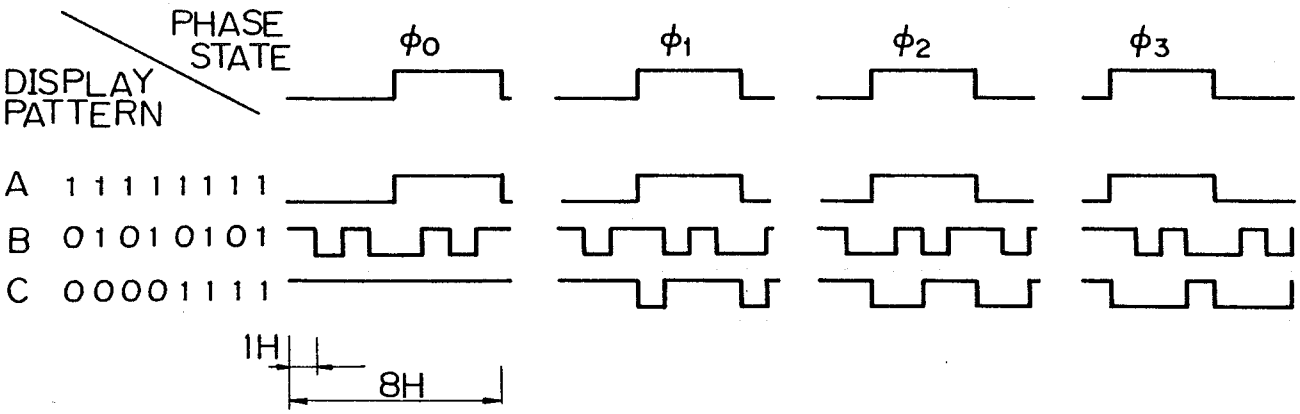

Another possible drive method which appears superficially similar to that of the present invention is illustrated in FIGS. 17A, 17B. Here, 8 different waveforms $\phi_0''$ to $\phi_7''$ are implemented in successive frames of an 8-frame cycle interval, with each of these waveforms comprising a cyclic repetition of four negative drive state row selection intervals followed by four positive drive state row selection intervals, and with each of the waveforms being successively shifted in phase by one row selection interval as shown in FIG. 17A. This drive method does not meet the essential requirements set by the present invention as described hereinabove, so that pattern dependence of the drive signals applied in the nonselection intervals of each display element occurs, as illustrated in FIG. 17B. Since each of waveforms $\phi_4''$ to $\phi_7''$ is the inverse of one of waveforms $\phi_0''$ to $\phi_3''$ respectively, it is only necessary to consider one period ( equal to 8 row selection intervals) of each of $\phi_0''$ to $\phi_3''$. As shown, the number of drive voltage polarity transitions depends strongly on the display pattern so that in fact such a method would not be effective.

With the method of the present invention however, the number of transitions of drive voltage polarity applied to a display element in a column in which any of the patterns 11111111, 01010101, or 00001111 is formed, during the non-selection intervals of that display element as measured over one or more sets of 4 consecutive frame intervals, will be identical for each pattern.

Figure 18:
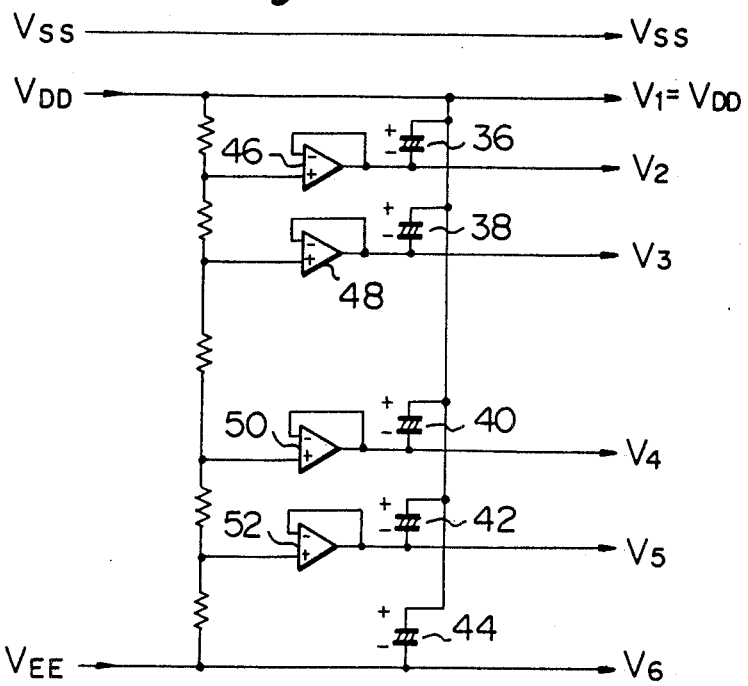
FIG. 18 is a general block circuit diagram to illustrate how the drive system of FIG. 10 can be adapted to utilize the drive method of the present invention.

In the case of a liquid crystal matrix display panel in which 100 rows are consecutively scanned in each frame interval, i.e. in which each display element is driven with a duty ratio of 1/100, and with the prior art B-waveform being utilized (as shown in FIGS. 4A, 4B), inversion of drive voltage polarity is performed once in every 100 rows of elements. However with the method of the present invention utilizing the C waveform, inversion is performed once in every two rows. As a result of the corresponding increase of frequency of the drive signals, the power consumption of the liquid crystal matrix display panel and of the drive circuits will be higher with the drive method of the present invention. For this reason, it is preferable to use a power supply of the form shown in FIG. 18 (i.e. as power supply 34 shown in FIG. 4). This employs operational amplifiers 46 to 52 to ensure a low level of output impedance, together with capacitors 36 to 44 of value 1 microfarad or higher, at the outputs of these operational amplifiers.

Figure 19:
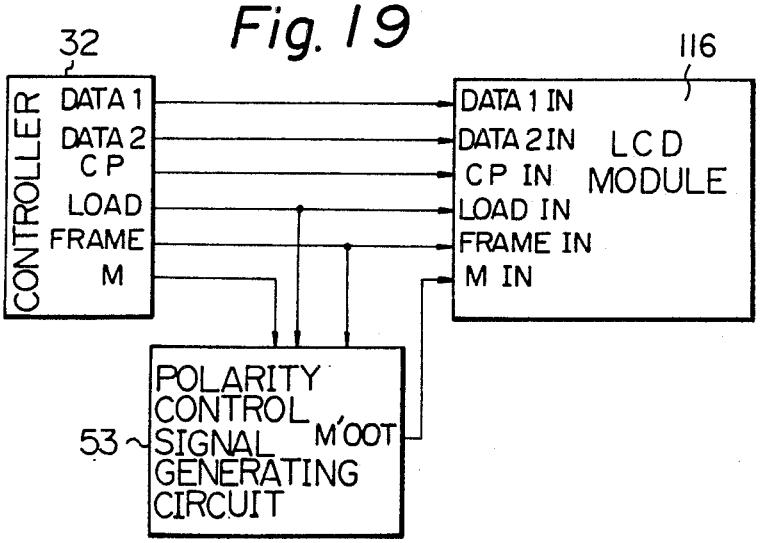
FIG. 19 is a circuit diagram of a suitable power supply arrangement for the drive system of FIG. 10, when this system is adapted for use with the method of the present

Commercially available integrated circuits for liquid crystal matrix display panel drive purposes will generally produce as output a polarity control signal having the B waveform described above. However, it is possible to easily derive a polarity control signal of the form used in the present invention from such an output signal. FIG. 19 shows an example of an arrangement whereby this can be done. A polarity control signal MOUT is produced from polarity control signal generating circuit 53. Numeral 116 denotes a LCD module block which is a combination of blocks 34 and 21 shown in FIG. 4.

Figure 20:
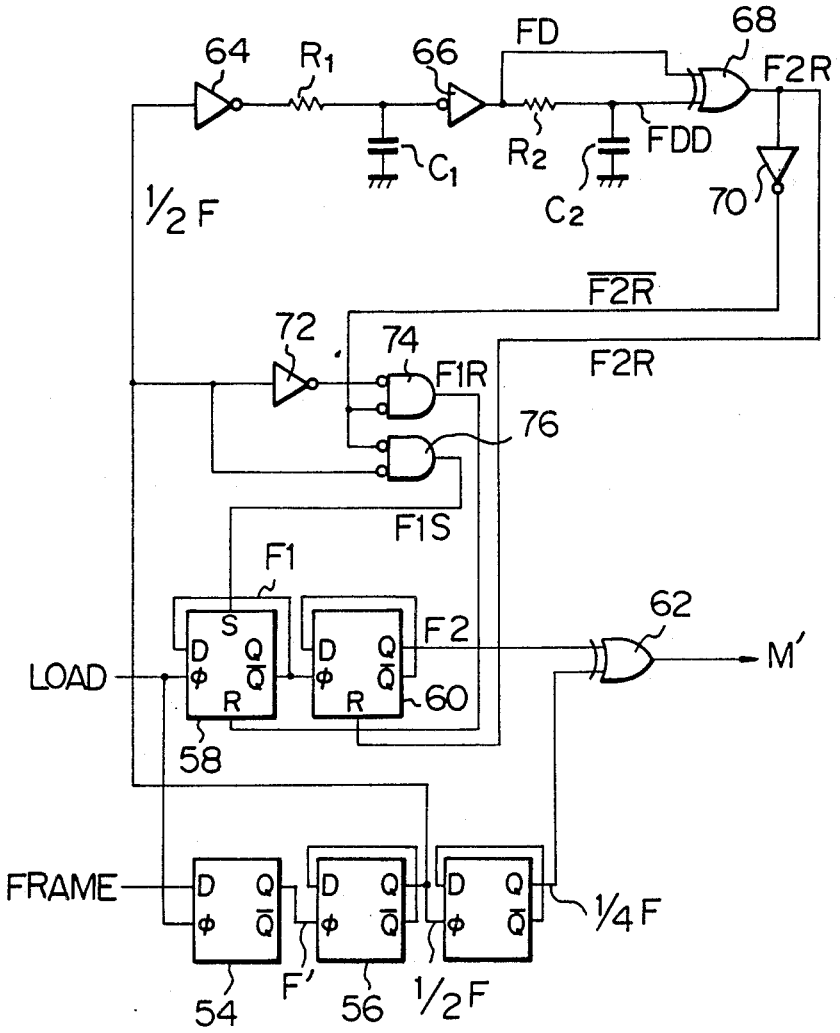
FIG. 20 is a circuit diagram of a specific circuit implementation of a polarity control signal generating circuit for use in applying the method of the present invention to the block diagram of FIG. 10.
Figure 21:
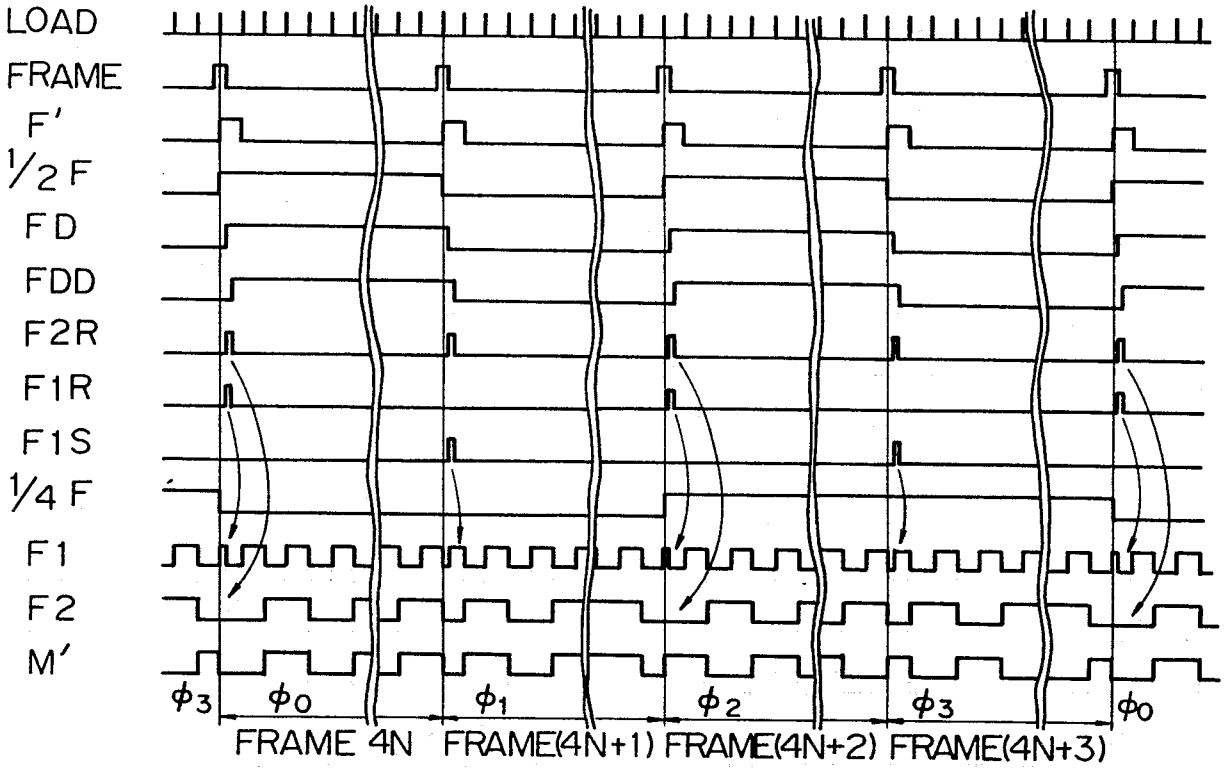
FIG. 21 is a timing chart for illustrating the operation of the circuit of FIG. 20.

FIG. 20 is a circuit diagram of an embodiment of polarity control signal generating circuit 53 in FIG. 19 and FIG. 21 is a timing chart for this circuit. In FIG. 20, numerals 58 and 32 denote series-connected flip-flops (abbreviated in the following to FF) which serve to perform $\frac{1}{4}$ frequency division of the LOAD signal pulses, to thereby produce the polarity control signal of the present invention, having a period of 4H. The other portions of this circuit serve to establish the four phase states of the signal.

FF 54 and 56 constitute a circuit serving to determine the interval during which the polarity control signal produces a specific phase state (i.e. $\phi_0$, $\phi_1$, $\phi_2$ or $\phi_3$ shown in FIG. 15). The frame signal is read into FF 54 by the LOAD signal, with signal F being thereby output. The $\frac{1}{2}$ frequency division of signal F is then performed, to produce the $\frac{1}{2}$ F signal. The half-period of this $\frac{1}{2}$ F signal is the time duration for which the polarity control signal remains at a specific phase state. The $\frac{1}{2}$ F signal is identical to a polarity control signal having the B waveform. Thus, to obtain a B waveform type of polarity control signal, it is only necessary to omit FFs 54 and 56. The $\frac{1}{2}$ F signal is delayed by a delay circuit comprising inverters 64 and 66, resistors R1 and R2, and capacitors C1 and C2. The resultant delayed signals FD and FDD are input to an Exclusive-OR gate (hereinafter abbreviated to ex-OR) which produces signal F2R. Signals F1R and F1F are then derived from signals F2R and $\frac{1}{2}$ F by inverters 70, 72 and gates 74, 76. Signal F1R is applied as a reset signal to FF 58, while signal F1S is applied as a set signal to FF 58.

Figure 6:
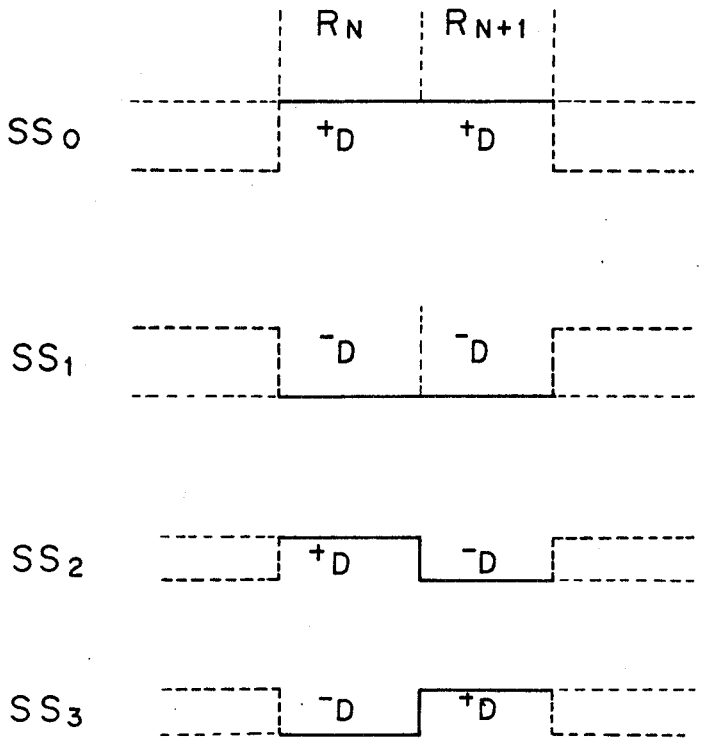
FIGS. 6, and 7 are diagrams illustrating drive voltage polarity alternation sub-sequences, for assistance in describing the basic concepts of the present invention.

Of the signals $\phi_0$ to $\phi_3$ shown in FIG. 6, signals $\phi_2$ and $\phi_3$ can be obtained by respectively inverting signals $\phi_1$ and $\phi_2$. Thus, by producing signals $\phi_1$ and $\phi_2$, then inverting these, signals $\phi_2$ and $\phi_3$ will be obtained. Signal $\phi_2$ takes the phase state of signal $\phi_0$ and the phase state of signal $\phi_1$ once in each frame. As shown in the timing chart of FIG. 14, when phase $\phi_0$ occurs in frame 4 N, then FF 58 becomes set at the begining of frame 4N+1, and signal F1 goes to the H level. As a result, the counter circuit constituted by FF 58 and 31 is in effect incremented by one, and signal F2 advances in phase by 1H. In frame 4 N+1, the phase of signal F2 becomes equivalent to signal $\phi_1$ shown in FIG. 15. At lhe beginning of frame 4 N+2, FF 58 becomes reset, and signal F1 goes to the L level.

When this occurs, FF 32 is reset at the same time, so that signal F2 is held at the L level. This is in effect equivalent to subtracting one from the count value held in the counter circuit constituted by FFs 58 and 31. Thus, signal F2 becomes delayed in phase by an amount 1H, and attains the phase state $\phi_0$. Similarly, in frame 4 N+3, signal F2 attains the phase state of signal $\phi_1$. If signal F2 is inverted once in every two frames, then during the two frames in which the signal is in the non-inverted state it will attain the phase states of signals $\phi_0$ and $\phi_1$, while during the two frames in which signal F2 is in the inverted state, it will attain the phase states of the inverses of signals $\phi_0$ and $\phi_1$, that is to say, the phase states of signals $\phi_3$ and $\phi_4$. Thus, by inputting signals F2 and $\frac{1}{2}$ F to an exclusive-OR gate, the M signal is obtained, i.e. a signal which sequentially attains the phase states $\phi_0$ to $\phi_3$. Thus, signal M is a polarity control signal according to the present invention, for providing the C type of drive signal.

Although the present invention has been described in the above with reference to specific embodiments, it should be noted that various changes and modifications to the embodiments may be envisaged, which fall within the scope claimed for the invention as set out in the appended claims. The above specification should therefore be interpreted in a descriptive and not in a limiting sense.

What is claimed is:

1. A method of driving a liquid crystal matrix display panel having a regular matrix array of liquid crystal display elements arranged in mutually perpendicular rows and columns and driven by common conductors and segment conductors which are respectively aligned with said rows and columns and are driven by common drive signals and segment drive signals, each of said common conductors being addressed once during each of successive frame intervals within a corresponding one of a set of row selection intervals in a frame interval, the method comprising generating a polarity control signal which varies between a first and a second potential and which controls said common and segment drive signals such that with said polarity control signal at said first potential, a positive drive voltage polarity is applied to a display element addressed during said corresponding row selection interval and such that with said polarity control signal at said second potential a negative drive voltage polarity is applied to a display element addressed during said row selection interval, said polarity control signal attaining a different waveform during respective frame intervals of each of successively occurring cycle intervals where each of said cycle intervals comprises four successive frame intervals, said polarity control signal waveforms being formed such that during each row selection interval of any set of two successive row selection intervals occurring at identical timings in each frame interval, said polarity control signal is established at said first potential during two of said frame intervals in said cycle interval, and at said second potential during the remaining two frame intervals of said cycle interval, with the order in which said polarity control signal is set to said first and second potentials in successive frame intervals of said cycle interval being respectively different for each of said two successive row selection intervals.

2. A drive method according to claim 1, in which said polarity control signal varies in accordance with first, second, third and fourth waveforms respectively during successive ones of said four frame intervals constituting said cycle interval, each of said waveforms having a period equal to four row selection intervals and each comprising a periodically repeated sequence of four successive row selection intervals during which said first potential is maintained, followed by two successive row selection intervals during which said second potential is maintained, with said second, third and fourth waveforms differing in phase from said first waveform by one, two and three row selection intervals respectively, with respect to the timing of the start of a frame interval.

3. A drive method according to claim 1, in which said polarity control signal varies in accordance with first, second, third and fourth waveforms respectively during successive ones of said four frame intervals constituting said cycle interval, each of said waveforms having a period equal to four row selection intervals, whereby during a period of said first first waveform beginning at an arbitrary timing following the start of a frame interval, said polarity control signal potential is maintained at said first potential during said first and second row selection intervals, at said second potential during a third row selection interval and at said first potential during a fourth row selection interval, and whereby during a corresponding period of said second waveform beginning at said arbitrary timing, said polarity control signal potential is maintained at said first potential during a first row selection interval and at said second potential during second, third and fourth row selection intervals, and moreover whereby during a corresponding period of said third waveform beginning at said arbitrary timing, said polarity control signal is maintained at said second potential during first and second row selection intervals, at said first potential during a third row selection interval, and at said second potential during a fourth row selection interval, and further whereby during a corresponding period of said fourth waveform beginning at said arbitrary timing, said polarity control signal is maintained at said first potential during a first row selection interval and at said second potential during second, third and fourth row selection intervals.

4. A drive method according to claim 2, in which said polarity control signal is held fixed at said first potential during a first frame interval of said cycle interval, is held fixed at said second potential during a second frame interval of said cycle interval, and is varied in accordance with first and second waveforms during the third and fourth frame intervals respectively of said cycle interval, whereby during a period of said waveform which begins at an arbitrary timing with respect to the start of a frame interval, said polarity control signal is maintained at said first potential during a first row selection interval and at said second potential during a second row selection interval, and whereby for a corresponding period of said second waveform beginning at said arbitrary timing, said polarity control signal is maintained at said second potential during a first row selection interval and at said first potential during a second row selection interval.

5. A method of driving a liquid crystal matrix display panel having a regular matrix array of liquid crystal display elements arranged in mutually perpendicular rows and columns and driven by common conductors and segment conductors which are respectively aligned with said rows and columns and are driven by common drive signals and segment drive signals, each of said common conductors being addressed once during each of successive frame intervals within a corresponding one of a set of row selection intervals in a frame interval, whereby for any pair of display elements formed of a first display element and second display element which are mutually adjacent in one of said columns and addressed during respective successively occurring row selection intervals in each of said frame intervals, during any four successive frame intervals, a drive voltage of a first polarity is applied to said first display element during said corresponding row selection interval in a first pair of said four successive frame intervals and a drive voltage of a second polarity is applied thereto during said corresponding row selection interval in the remaining pair of said four successive frame intervals, and whereby a drive voltage of said first polarity is applied to said second display element during said corresponding row selection interval in a pair of said four successive frame intervals which are different from said first pair, and a drive voltage of said second polarity is applied to said second display element during said corresponding row selection intervals in the remaining pair of said four successive frame intervals.

6. A method of driving a liquid crystal matrix display panel having a regular matrix array of liquid crystal display elements arranged in mutually perpendicular rows and columns and driven by common conductors and segment conductors which are respectively aligned with said rows and columns and are driven by common drive signals and segment drive signals, each of said common conductors being addressed once during each of successive frame intervals within a corresponding one of a set of row selection intervals in a frame interval, whereby for any pair of display elements formed of a first display element and second display element which are mutually adjacent in one of said columns and addressed during respective successively occurring row selection intervals in each of said frame intervals, during any four successive frame intervals, said first display element and said second display element are each driven during said respective row selection intervals by drive signals of a first polarity during two of said four successive frame intervals and by drive signals of a second polarity during the remaining two of said four successive frame intervals, with the sequence of drive voltage polarity alternations applied to said first display element during said respective row selection intervals in said four successive frame intervals being made different from the sequence of drive voltage polarity alternations applied to said second display element during said respective row selection intervals in said four successive frame intervals.

* * * * *